US009016409B2

(12) United States Patent
Zhang et al.

(10) Patent No.: US 9,016,409 B2
(45) Date of Patent: Apr. 28, 2015

(54) ROLLING CUTTER PLACEMENT ON PDC BITS

(75) Inventors: Youhe Zhang, Spring, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 92 days.

(21) Appl. No.: 13/303,837

(22) Filed: Nov. 23, 2011

(65) Prior Publication Data

US 2012/0132471 A1 May 31, 2012

Related U.S. Application Data

(63) Continuation of application No. 13/111,453, filed on May 19, 2011, now Pat. No. 8,881,849.

(60) Provisional application No. 61/346,260, filed on May 19, 2010.

(51) Int. Cl.

| | |
|---|---|
| ***E21B 10/36*** | (2006.01) |
| ***E21B 10/573*** | (2006.01) |
| ***E21B 10/627*** | (2006.01) |
| ***E21B 10/43*** | (2006.01) |

(52) U.S. Cl.

CPC ..... *E21B 10/43* (2013.01); *E21B 10/627* (2013.01); *E21B 10/573* (2013.01)

(58) Field of Classification Search

USPC ..... 175/331, 426, 431

See application file for complete search history.

(56) References Cited

U.S. PATENT DOCUMENTS

| | | | | |
|---|---|---|---|---|
| 4,104,344 | A | 8/1978 | Pope et al. | |
| 4,288,248 | A | 9/1981 | Bovenkerk et al. | |
| 4,553,615 | A | 11/1985 | Grainger | |
| 4,738,322 | A | 4/1988 | Hall et al. | |
| 4,756,631 | A | 7/1988 | Jones | |
| 5,127,923 | A | 7/1992 | Bunting et al. | |
| 5,494,477 | A | 2/1996 | Flood et al. | |
| 5,662,720 | A | 9/1997 | O'Tighearnaigh | |
| 2003/0037964 | A1 | 2/2003 | Sinor et al. | |
| 2006/0180356 | A1 | 8/2006 | Durairajan et al. | |
| 2007/0278017 | A1 * | 12/2007 | Shen et al. | 175/426 |
| 2010/0089661 | A1 | 4/2010 | Welch et al. | |
| 2011/0155472 | A1 | 6/2011 | Lyons et al. | |
| 2011/0284293 | A1 | 11/2011 | Shen et al. | |
| 2011/0297454 | A1 | 12/2011 | Shen et al. | |

OTHER PUBLICATIONS

International Search Report and Written Opinion of PCT Application No. PCT/US2012/065981 dated Mar. 25, 2013: pp. 1-11.

International Search Report and Written Opinion issued in related International Patent Application No. PCT/US2011/037187; Dated Nov. 15, 2011 (8 pages).

* cited by examiner

*Primary Examiner* — Cathleen Hutchins

(74) *Attorney, Agent, or Firm* — Osha Liang LLP

(57) ABSTRACT

A cutting tool cutting tool may include a tool body having a plurality of blades extending radially therefrom; and a plurality of rotatable cutting elements mounted on at least one of the plurality of blades, wherein the plurality of rotatable cutting elements are mounted on the at least one blade in a nose and/or shoulder region of the cutting tool at a side rake angle ranging from about 10 to about 30 degrees or −10 to about −30 degrees.

35 Claims, 16 Drawing Sheets

ROLLING CUTTER PLACEMENT ON PDC BITS

CROSS-REFERENCE TO RELATED APPLICATIONS

This application is a continuation-in-part of U.S. patent application Ser. No. 13/111,453, filed on May 19, 2011, which claims priority under 35 U.S.C. §119(e) to U.S. Provisional Application Ser. No. 61/346,260, filed May 19, 2010, both of which are herein incorporated by reference in their entirety.

BACKGROUND

1. Technical Field

Embodiments disclosed herein relate generally to cutting elements for drilling earth formations. More specifically, embodiments disclosed herein relate generally to rotary drill bits having rotatable cutting elements installed thereon.

2. Background Art

Drill bits used to drill wellbores through earth formations generally are made within one of two broad categories of bit structures. Drill bits in the first category are generally known as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the second category are typically referred to as "fixed cutter" or "drag" bits. This category of bits has no moving elements but rather have a bit body formed from steel or another high strength material and cutters (sometimes referred to as cutter elements, cutting elements or inserts) attached at selected positions to the bit body. For example, the cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1*a*. A drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired backrake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14, and the cutters 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultra hard cutter is to be used, the bit body 12 may be made from powdered tungsten carbide (WC) infiltrated with a binder alloy within a suitable mold form. In one manufacturing process the crown 26 includes a plurality of holes or pockets 34 that are sized and shaped to receive a corresponding plurality of cutters 18.

The combined plurality of surfaces 20 of the cutters 18 effectively forms the cutting face of the drill bit 10. Once the crown 26 is formed, the cutters 18 are positioned in the pockets 34 and affixed by any suitable method, such as brazing, adhesive, mechanical means such as interference fit, or the like. The design depicted provides the pockets 34 inclined with respect to the surface of the crown 26. The pockets 34 are inclined such that cutters 18 are oriented with the working face 20 at a desired rake angle in the direction of rotation of the bit 10, so as to enhance cutting. It should be understood that in an alternative construction (not shown), the cutters may each be substantially perpendicular to the surface of the crown, while an ultra hard surface is affixed to a substrate at an angle on a cutter body or a stud so that a desired rake angle is achieved at the working surface.

A typical cutter 18 is shown in FIG. 1*b*. The typical cutter 18 has a cylindrical cemented carbide substrate body 38 having an end face or upper surface 54 referred to herein as the "interface surface" 54. An ultra hard material layer (cutting layer) 44, such as polycrystalline diamond or polycrystalline cubic boron nitride layer, forms the working surface 20 and the cutting edge 22. A bottom surface 52 of the ultra hard material layer 44 is bonded on to the upper surface 54 of the substrate 38. The bottom surface 52 and the upper surface 54 are herein collectively referred to as the interface 46. The top exposed surface or working surface 20 of the cutting layer 44 is opposite the bottom surface 52. The cutting layer 44 typically has a flat or planar working surface 20, but may also have a curved exposed surface, that meets the side surface 21 at a cutting edge 22.

Generally speaking, the process for making a cutter 18 employs a body of tungsten carbide as the substrate 38. The carbide body is placed adjacent to a layer of ultra hard material particles such as diamond or cubic boron nitride particles and the combination is subjected to high temperature at a pressure where the ultra hard material particles are thermodynamically stable. This results in recrystallization and formation of a polycrystalline ultra hard material layer, such as a polycrystalline diamond or polycrystalline cubic boron nitride layer, directly onto the upper surface 54 of the cemented tungsten carbide substrate 38.

One type of ultra hard working surface 20 for fixed cutter drill bits is formed as described above with polycrystalline diamond on the substrate of tungsten carbide, typically known as a polycrystalline diamond compact (PDC), PDC cutters, PDC cutting elements, or PDC inserts. Drill bits made using such PDC cutters 18 are known generally as PDC bits. While the cutter or cutter insert 18 is typically formed using a cylindrical tungsten carbide "blank" or substrate 38 which is sufficiently long to act as a mounting stud 40, the substrate 38 may also be an intermediate layer bonded at another interface to another metallic mounting stud 40.

The ultra hard working surface 20 is formed of the polycrystalline diamond material, in the form of a cutting layer 44 (sometimes referred to as a "table") bonded to the substrate 38 at an interface 46. The top of the ultra hard layer 44 provides a working surface 20 and the bottom of the ultra hard layer cutting layer 44 is affixed to the tungsten carbide substrate 38 at the interface 46. The substrate 38 or stud 40 is brazed or otherwise bonded in a selected position on the crown of the drill bit body 12 (FIG. 1*a*). As discussed above with reference to FIG. 1*a*, the PDC cutters 18 are typically held and brazed into pockets 34 formed in the drill bit body at predetermined positions for the purpose of receiving the cutters 18 and presenting them to the geological formation at a rake angle.

Bits 10 using conventional PDC cutters 18 are sometimes unable to sustain a sufficiently low wear rate at the cutter temperatures generally encountered while drilling in abrasive and hard rock. These temperatures may affect the life of the bit 10, especially when the temperatures reach 700-750° C., resulting in structural failure of the ultra hard layer 44 or PDC cutting layer. A PDC cutting layer includes individual diamond "crystals" that are interconnected. The individual diamond crystals thus form a lattice structure. A metal catalyst, such as cobalt may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

It has been found by applicants that many cutters 18 develop cracking, spalling, chipping and partial fracturing of the ultra hard material cutting layer 44 at a region of cutting layer subjected to the highest loading during drilling. This region is referred to herein as the "critical region" 56. The critical region 56 encompasses the portion of the ultra hard material layer 44 that makes contact with the earth formations during drilling. The critical region 56 is subjected to high magnitude stresses from dynamic normal loading, and shear loadings imposed on the ultra hard material layer 44 during drilling. Because the cutters are typically inserted into a drag bit at a rake angle, the critical region includes a portion of the ultra hard material layer near and including a portion of the layer's circumferential edge 22 that makes contact with the earth formations during drilling.

The high magnitude stresses at the critical region 56 alone or in combination with other factors, such as residual thermal stresses, can result in the initiation and growth of cracks 58 across the ultra hard layer 44 of the cutter 18. Cracks of sufficient length may cause the separation of a sufficiently large piece of ultra hard material, rendering the cutter 18 ineffective or resulting in the failure of the cutter 18. When this happens, drilling operations may have to be ceased to allow for recovery of the drag bit and replacement of the ineffective or failed cutter. The high stresses, particularly shear stresses, may also result in delamination of the ultra hard layer 44 at the interface 46.

In some drag bits, PDC cutters 18 are fixed onto the surface of the bit 10 such that a common cutting surface contacts the formation during drilling. Over time and/or when drilling certain hard but not necessarily highly abrasive rock formations, the edge 22 of the working surface 20 that constantly contacts the formation begins to wear down, forming a local wear flat, or an area worn disproportionately to the remainder of the cutting element. Local wear flats may result in longer drilling times due to a reduced ability of the drill bit to effectively penetrate the work material and a loss of rate of penetration caused by dulling of edge of the cutting element. That is, the worn PDC cutter acts as a friction bearing surface that generates heat, which accelerates the wear of the PDC cutter and slows the penetration rate of the drill. Such flat surfaces effectively stop or severely reduce the rate of formation cutting because the conventional PDC cutters are not able to adequately engage and efficiently remove the formation material from the area of contact. Additionally, the cutters are typically under constant thermal and mechanical load. As a result, heat builds up along the cutting surface, and results in cutting element fracture. When a cutting element breaks, the drilling operation may sustain a loss of rate of penetration, and additional damage to other cutting elements, should the broken cutting element contact a second cutting element.

Additionally, another factor in determining the longevity of PDC cutters is the generation of heat at the cutter contact point, specifically at the exposed part of the PDC layer caused by friction between the PCD and the work material. This heat causes thermal damage to the PCD in the form of cracks which lead to spalling of the polycrystalline diamond layer, delamination between the polycrystalline diamond and substrate, and back conversion of the diamond to graphite causing rapid abrasive wear. The thermal operating range of conventional PDC cutters is typically 750° C. or less.

In U.S. Pat. No. 4,553,615, a rotatable cutting element for a drag bit was disclosed with an objective of increasing the lifespan of the cutting elements and allowing for increased wear and cuttings removal. The rotatable cutting elements disclosed in the '615 patent include a thin layer of an agglomerate of diamond particles on a carbide backing layer having a carbide spindle, which may be journalled in a bore in a bit, optionally through an annular bush. With significant increases in loads and rates of penetration, the cutting element of the '615 patent is likely to fail by one of several failure modes. Firstly, thin layer of diamond is prone to chipping and fast wearing. Secondly, geometry of the cutting element would likely be unable to withstand heavy loads, resulting in fracture of the element along the carbide spindle. Thirdly, the retention of the rotatable portion is weak and may cause the rotatable portion to fall out during drilling. Fourthly, the prior art does not disclose optimization of the location of rotatable cutting elements on a bit body.

Accordingly, there exists a continuing need for cutting elements that may stay cool and avoid the generation of local wear flats, and the incorporation of those cutting elements on a drill bit or other cutting tool.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting tool that includes a tool body having a plurality of blades extending radially therefrom; and a plurality of rotatable cutting elements mounted on at least one of the plurality of blades, wherein the plurality of rotatable cutting elements are mounted on the at least one blade in a forward spiral configuration, and wherein each of the plurality of rotatable cutting elements has a negative side rake angle.

In another aspect, embodiments disclosed herein relate to a cutting tool that includes a tool body having a plurality of blades extending radially therefrom; and a plurality of rotatable cutting elements mounted on at least one of the plurality of blades, wherein the plurality of rotatable cutting elements are mounted on the at least one blade in a reverse spiral configuration, and wherein each of the plurality of rotatable cutting elements has a positive side rake angle.

In yet another aspect, embodiments disclosed herein relate to a cutting tool cutting tool that includes a tool body having a plurality of blades extending radially therefrom; and a plurality of rotatable cutting elements mounted on at least one of the plurality of blades, wherein the plurality of rotatable cutting elements are mounted on the at least one blade in a nose and/or shoulder region of the cutting tool at a side rake angle ranging from about 10 to about 30 degrees or −10 to about −30 degrees.

Other aspects and advantages of the invention will be apparent from the following description and the appended claims.

DETAILED DESCRIPTION

In one aspect, embodiments disclosed herein relate to bit design using rotatable cutting structures. Specifically, embodiments disclosed herein relate to improving the life of a drill bit by positioning rotatable cutting elements in particular arrangements on the drill bit.

Generally, rotatable cutting elements (also referred to as rolling cutters) described herein allow at least one surface or portion of the cutting element to rotate as the cutting elements contact a formation. As the cutting element contacts the formation, the cutting action may allow portion of the cutting element to rotate around a cutting element axis extending through the cutting element. Rotation of a portion of the cutting structure may allow for a cutting surface to cut the formation using the entire outer edge of the cutting surface, rather than the same section of the outer edge, as observed in a conventional cutting element. The following discussion describes various embodiments for a rotatable cutting element; however, the present disclosure is not so limited. One skilled in the art would appreciate that any cutting element capable of rotating may be used with the drill bit or other cutting tool of the present disclosure.

The rotation of the inner rotatable cutting element may be controlled by the side cutting force and the frictional force between the bearing surfaces. If the side cutting force generates a torque which can overcome the torque from the frictional force, the rotatable portion will have rotating motion. The side cutting force may be affected by cutter side rake, back rake and geometry, including the working surface patterns disclosed herein. Additionally, the side cutting force may be affected by the surface finishing of the surfaces of the cutting element components, the frictional properties of the formation, as well as drilling parameters, such as depth of cut. The frictional force at the bearing surfaces may affected, for example, by surface finishing, mud intrusion, etc. The design of the rotatable cutters disclosed herein may be selected to ensure that the side cutting force overcomes the frictional force to allow for rotation of the rotatable portion. Various design considerations of the present disclosure are described below, as well as exemplary embodiments of rolling cutters.

Placement of Rolling Cutters

Figure 8:
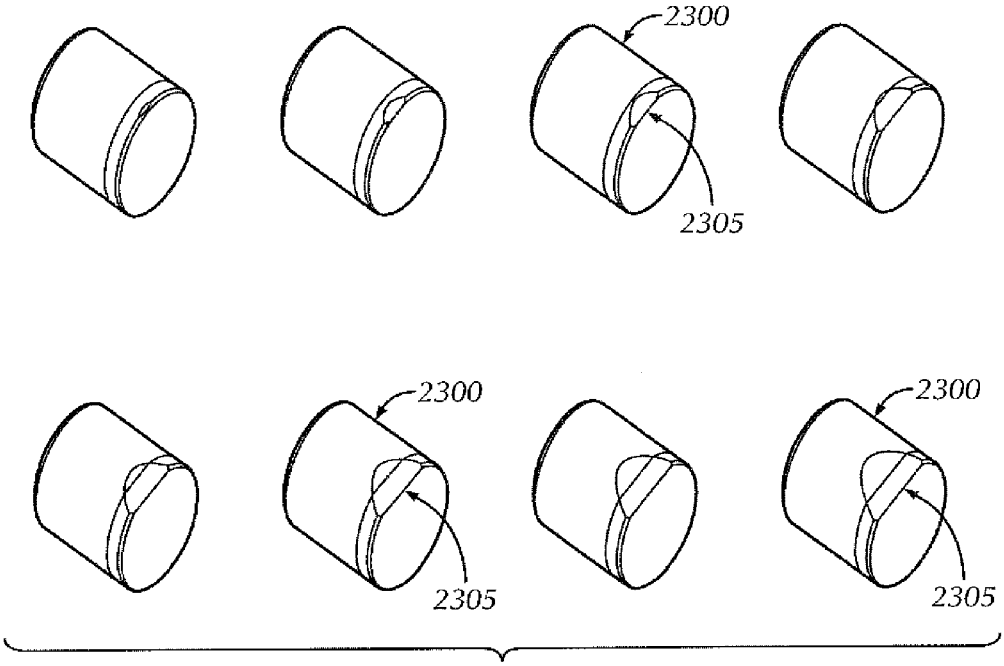
FIG. 8 shows the progression of a wear flat in a conventional cutting element.

According to embodiments of the present disclosure, a bit design consideration may include placement of rolling cutters on a drill bit. Placement design of rolling cutters on a drill bit may involve, first, predicting where conventional cutter (fixed cutter) wear occurs most frequently or quickly on a drill bit. For example, fixed cutter wear may be predicted using engineering and design software, such as I-DEAS, "Integrated Design and Engineering Analysis Software", or CAD software. Such engineering and design software may also be used to optimize bit stabilization dynamics using various placements of rolling cutters. Fixed cutter wear may also be predicted by observing and/or measuring wear flat sizes on dull drill bits. In particular, as a drill bit having conventional, fixed cutters contacts and cuts an earthen formation, the cutting surface and cutting edge of a fixed cutter may wear and form a wear flat. An example of a wear flat 2305 progression in a fixed cutter 2300 is shown in FIG. 8.

Once fixed cutter wear is predicted, criteria for the placement of rolling cutters may be set according to where the fixed cutter wear occurs. For example, according to embodiments of the present disclosure, rolling cutter placement design may include replacing fixed cutters having the most amount of wear with rolling cutters. In one embodiment, rolling cutter placement design may include replacing half of the total number of fixed cutters experiencing the largest amount of wear with rolling cutters. Further, in other embodiments, rolling cutter placement design may include replacing fixed cutters with rolling cutters on only certain blades of a drill bit.

Figure 9A:
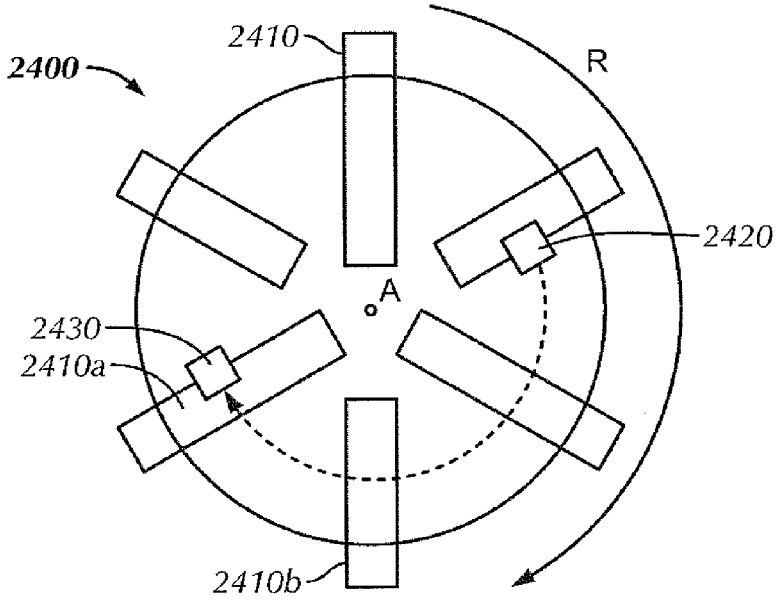
FIGS. 9A-B show profile views of a drill bit according to embodiments disclosed herein.
Figure 9B:
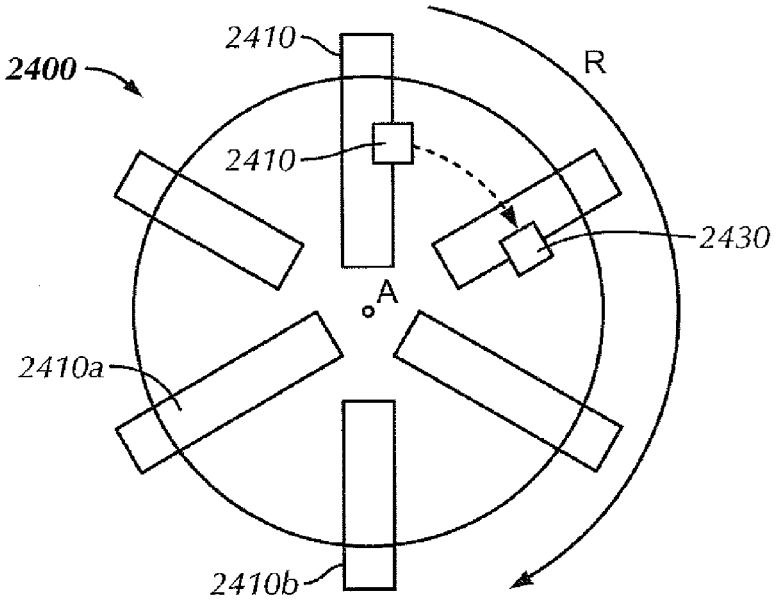

According to embodiments of the present disclosure, rolling cutter placement design criteria may be set so that rolling cutters and fixed cutters on a drill bit have a plural set configuration. Drill bits having a plural set configuration have more than one cutting element at at least one radial position with respect to the bit axis. Expressed alternatively, at least one cutting element includes a "back up" cutting element disposed at about the same radial position with respect to the bit axis. For example, referring to FIGS. 9A and 9B, a face side profile view of a drill bit 2400 having a plurality of cutting blades 2410 are shown, wherein the bits rotate in direction R. Primary blades 2410*a* extend radially from substantially proximal the longitudinal axis A of the bit toward the periphery of the bit. Secondary blades 2410*b* do not extend from substantially proximal the bit axis A, but instead extend radially from a location that is a distance away from the bit axis A. Cutting elements 2420, 2430 are positioned at the leading side of blades 2410, wherein the leading sides of blades 2410 face in the direction of bit rotation R and trailing sides of blades face the opposite direction. Further, as shown, cutting element 2420 trails cutting element 2430 in plural set configuration, i.e., cutting element 2420 "backs up" cutting element 2430 at about the same radial position with respect to the bit axis A. Either cutting element 2420 or cutting element 2430, or both cutting elements 2420 and 2430, may be rolling cutters. In a particular embodiment, a bit having a plural set cutter configuration may have at least one trailing or backup cutting element that is rotatable (a rolling cutter) and at least one leading or primary cutting element that is a fixed cutter. In another embodiment, a bit having a plural set configuration may have at least one fixed cutter trailing cutting element and at least one rolling cutter leading cutting element. Advantageously, by using a plural set configuration having at least one rolling cutter, the cutting structure may be more robust.

Figure 14:
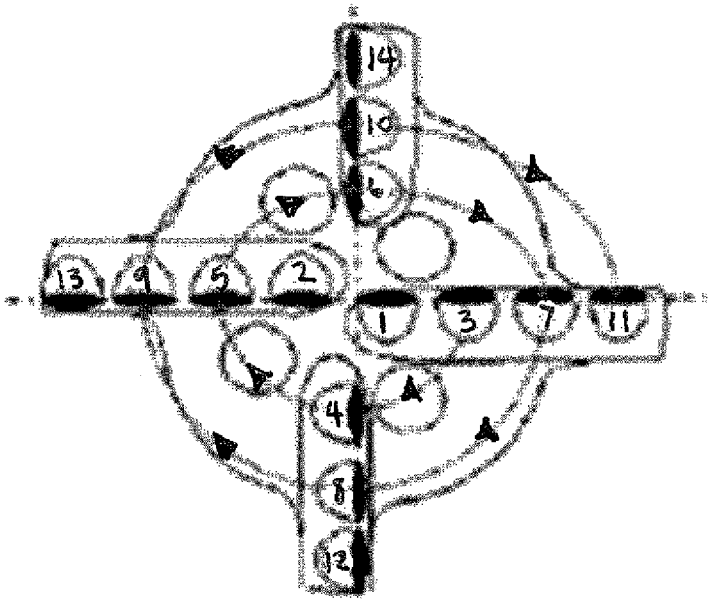
FIG. 14 shows a top view of the cutting end of a drill bit.
Figure 15:
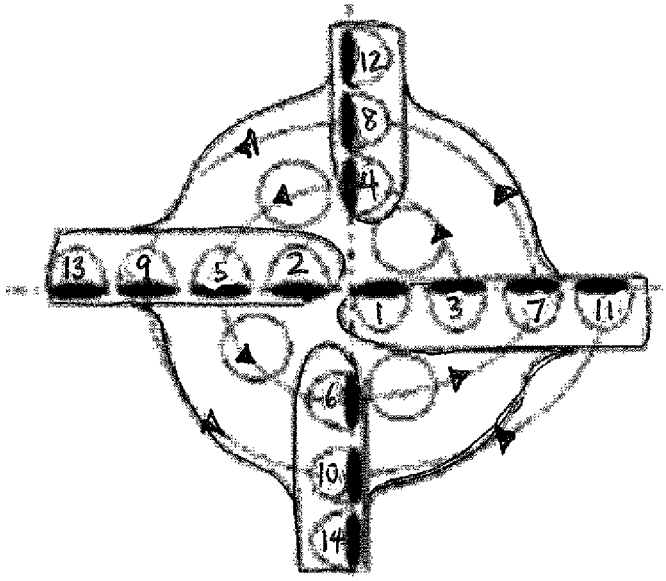
FIG. 15 shows a top view of the cutting end of a drill bit.

Further, a bit may have a single set configuration of cutting elements, wherein each cutting element in a single set configuration is at a unique radial position of the bit. In embodiments having a single set configuration, a plurality of rolling cutters may be placed at various unique radial positions with respect to the bit axis. For example, a plurality of rolling cutters may have a forward spiral or a reverse spiral single set configuration, wherein the rolling cutters are placed in Further, a bit may have a single set configuration of cutting elements, wherein each cutting element in a single set configuration is at a unique radial position of the bit. In embodiments having a single set configuration, a plurality of rolling cutters may be placed at various unique radial positions with respect to the bit axis. For example, a plurality of rolling cutters may have a forward spiral or a reverse spiral single set configuration, wherein the rolling cutters are placed in areas experiencing wear. As used herein, a forward spiral layout refers to a cutter placement where cutters having incrementally increasing radial distances from the bit centerline are placed in a clockwise distribution, as illustrated in FIG. 14, whereas a reverse spiral layout refers to a cutter placement where cutters having incrementally increasing radial distances from a bit centerline are placed in a counterclockwise distribution, as illustrated in FIG. 15. In some embodiments, the cutters may be placed in a forward spiral, where rotatable cutters are at least placed in the nose and/or shoulder region are rotatable, are placed in the nose, shoulder, and gage regions in particular embodiments, and are placed in the cone, nose, shoulder, and gage regions in more particular embodiments. In some embodiments, the cutters may be placed in a reverse spiral, where rotatable cutters are at least placed in the nose and/or shoulder region are rotatable, are placed in the nose, shoulder, and gage regions in particular embodiments, and are placed in the cone, nose, shoulder, and gage regions in more particular embodiments.

Additionally, leading and trailing cutting elements may be placed on a single blade. However, as used herein, the term "backup cutting element" is used to describe a cutting element that trails any other cutting element on the same blade when the bit is rotated in the cutting direction. Further, as used herein, the term "primary cutting element" is used to describe a cutting element provided on the leading edge of a blade. In other words, when a bit is rotated about its central longitudinal axis in the cutting direction, a "primary cutting element" does not trail any other cutting elements on the same blade. Suitably, each primary cutting elements and optional backup cutting element may have any suitable size and geometry. Primary cutting elements and backup cutting elements may have any suitable location and orientation and may be rolling cutters or fixed cutters. In an example embodiment, backup cutting elements may be located at the same radial position as the primary cutting element it trails, or backup cutting elements may be offset from the primary cutting element it trails, or combinations thereof may be used.

In particular, each blade on a bit face (e.g., primary blades and secondary blades) provides a cutter-supporting surface to which cutting elements are mounted. Primary cutting elements may be disposed on the cutter-supporting surface of the blades and one or more of the primary blades may also have backup cutting elements disposed on the cutter-supporting surface of the bit. In an exemplary embodiment, backup cutting elements may be provided on the cutter-supporting surface of one or more of the bit primary blades in the cone region. In a different example embodiment, backup cutting elements may be provided on the cutter-supporting surface of any one or more secondary blades in the shoulder and/or gage region. In another example embodiment, backup cutting elements may be provided on the cutter-supporting surface of any one or more primary blades in the gage region. In yet another example embodiment, the primary and/or secondary blades may have at least two rows of backup cutting elements disposed on the cutter-supporting surfaces.

Primary cutting elements may be placed adjacent one another generally in a first row extending radially along each primary blade of a bit and along each secondary blade of a bit. Further, backup cutting elements may be placed adjacent one another generally in a second row extending radially along each primary blade in the shoulder region. Suitably, the backup cutting elements form a second row that may extend along each primary blade in the shoulder region, cone region and/or gage region. Backup cutting elements may be placed behind the primary cutting elements on the same primary blade, wherein backup cutting elements trail the primary cutting elements on the same primary blades.

In general, primary cutting elements as well as backup cutting elements need not be positioned in rows, but may be mounted in other suitable arrangements provided each cutting element is either in a leading position (e.g., primary cutting element) or a trailing position (e.g., backup cutting element). Examples of suitable arrangements may include without limitation, rows, arrays or organized patterns, randomly, sinusoidal pattern, or combinations thereof. Further, in other embodiments, additional rows of cutting elements may be provided on a primary blade, secondary blade, or combinations thereof.

Figure 10:
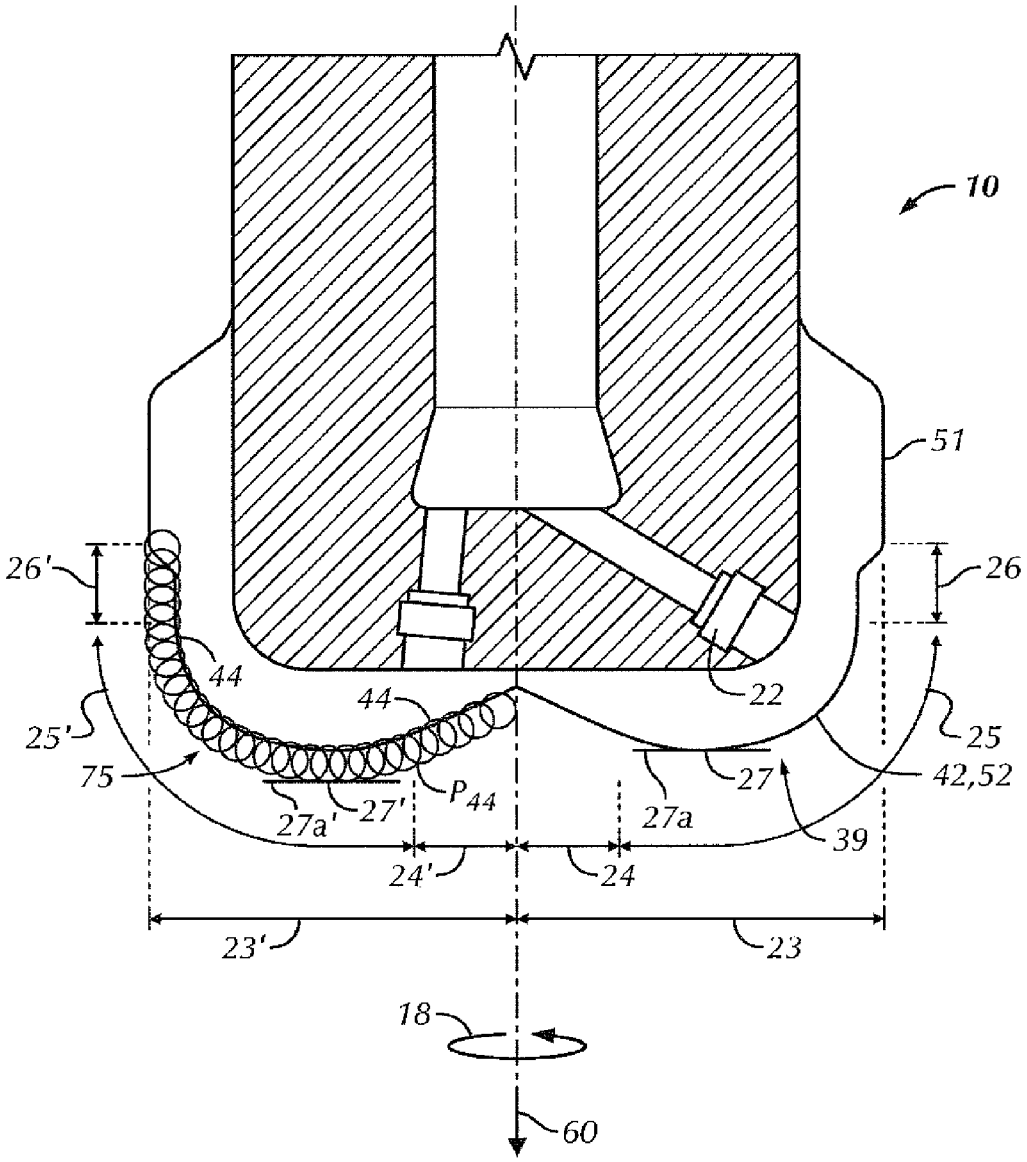
FIG. 10 shows a rotated profile view of a drill bit according to embodiments disclosed herein.

In some embodiments of the present disclosure, rolling cutter placement design criteria may be set so that rolling cutters are positioned in the areas of the bit experiencing the greatest wear. For example, rolling cutters may be placed in the shoulder region of a drill bit. Referring to FIG. 10, a profile 39 of a bit 10 is shown as it would appear with all blades and all cutting elements (including primary cutting elements and back up cutting elements) rotated into a single rotated profile. A blade profile 39 (most clearly shown in the right half of bit 10 in FIG. 10) may generally be divided into three regions conventionally labeled cone region 24, shoulder region 25, and gage region 26. Cone region 24 comprises the radially innermost region of bit 10 (e.g., cone region 24 is the central most region of bit 10) and composite blade profile 39 extending generally from bit axis 11 to shoulder region 25. As shown in FIG. 10, in most fixed cutter bits, cone region 24 is generally concave. Adjacent cone region 24 is shoulder (or the upturned curve) region 25. Thus, composite blade profile 39 of bit 10 includes one concave region—cone region 24, and one convex region—shoulder region 25. In most fixed cutter bits, shoulder region 25 is generally convex. Moving radially outward, adjacent shoulder region 25 is the gage region 26 which extends parallel to bit axis 11 at the outer radial periphery 23 of composite blade profile 39. Outer radius 23 extends to and therefore defines the full gage diameter of bit 10. Cone region 24 is defined by a radial distance along the x-axis measured from central axis 11. It is understood that the x-axis is perpendicular to central axis 11 and extends radially outward from central axis 11. Cone region 24 may be defined by a percentage of outer radius 23 of bit 10. The actual radius of cone region 24, measured from central axis 11, may vary from bit to bit depending on a variety of factors including without limitation, bit geometry, bit type, location of one or more secondary blades, location of back up cutting elements 50, or combinations thereof. The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most fixed cutter bits (e.g., bit 10), the composite blade profile includes only one convex shoulder region (e.g., convex shoulder region 25), and only one blade profile nose (e.g., nose 27). Advantageously, by placing rolling cutters in areas of the bit experiencing the greatest wear, for example at the shoulder region 26 of a bit, the wear rate of the bit may be improved.

Further, in a particular embodiment, a bit may have cutting elements placed in a single set configuration with rolling cutters placed in areas of the bit experiencing the greatest wear. In another embodiment, a bit may have cutting elements placed in a plural set configuration, wherein at least one rolling cutter is placed in areas of the bit experiencing the greatest wear.

Position of Rolling Cutters

Bit design considerations of the present disclosure may further include positioning of rolling cutters on a drill bit. Position design of rolling cutters on a drill bit may include adjusting the back rake (i.e., vertical orientation) and the side rake (i.e., a lateral orientation) of the cutting element, or adjusting the extension height of the cutting element, for example.

Figure 11:
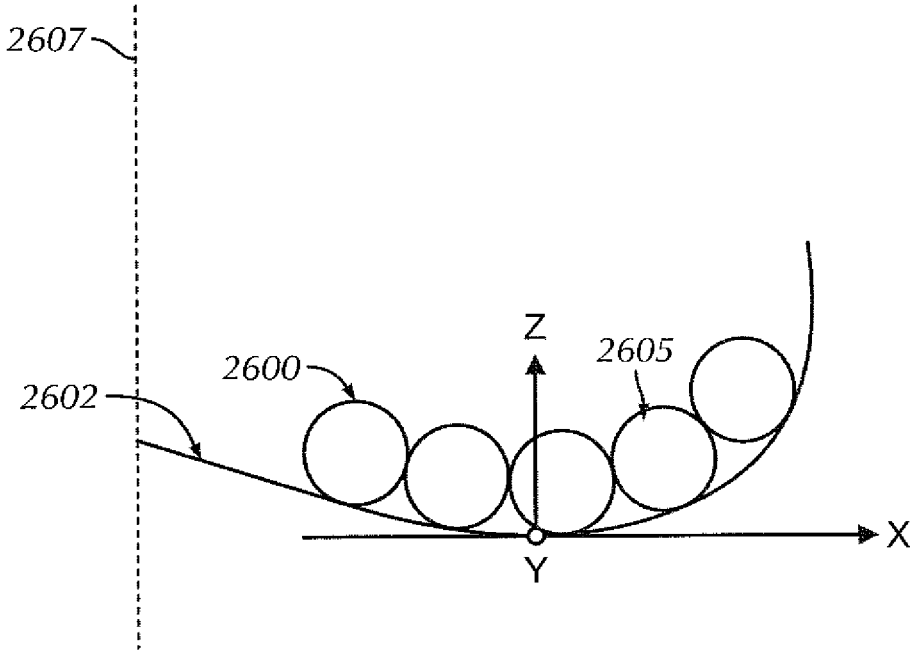
FIG. 11 shows a bit profile according to one embodiment disclosed herein.

Referring to FIG. 11, a cutting structure profile of a bit according to one embodiment is shown. As shown in this embodiment, cutters 2600 positioned on a blade 2602 may have side rake or back rake. Side rake is defined as the angle between the cutting face 2605 and the radial plane of the bit (x-z plane). When viewed along the z-axis, a negative side rake results from counterclockwise rotation of the cutter 2600, and a positive side rake, from clockwise rotation. Back rake is defined as the angle subtended between the cutting face 2605 of the cutter 2600 and a line parallel to the longitudinal axis 2607 of the bit. In one embodiment, a cutter may have a side rake ranging from 0 to ±45 degrees, for example 5 to ±35 degrees, 10 to ±35 degrees or 15 to ±30 degrees. In a particular embodiment, the direction (positive or negative) of the side rake may be selected based on the cutter distribution, i.e., whether the cutters are arranged in a forward or reverse spiral configuration. For example, in embodiments, if cutters are arranged in a reverse spiral, positive side rake angles may be particularly desirable. Conversely, if cutters are arranged in a forward spiral, negative side rake angles may be particularly desirable.

In some embodiments, each rolling cutter placed in the nose and/or shoulder region of the bit may have a side rake ranging from 10 to 30 degrees or −10 to 30 degrees. In other embodiments, each rolling cutter placed in the nose and/or shoulder region of the bit may have a side rake ranging from 20 to 30 degrees or −20 to −30 degrees. In some embodiments, rolling cutters radially outside the shoulder, i.e., in the gage region, may range from 5 to 35 degrees or −5 to −35 degrees. In more particular embodiments, rolling cutters in the gage region may be >5 degrees, >10 degrees, >15 degrees, >20 degrees, >25 degrees, >30 degrees, and/or <10 degrees, <15 degrees, <20 degrees, <25, <30 degrees, <35 degrees, with any of such angles being positive or negative, and any upper limit being used with any lower limit. Further, in some embodiments, cutters may be placed in the cone region of the bit may have a side rake of less than 20 degrees or ranging from 10 to 15 degrees in more particular embodiments. In various embodiments, cutters in the cone region may be either fixedly attached or may be rolling, but may have such side rake range if fixed or rolling. It is specifically understood that any of the side rake angles for any region may be used in singly or in combination with any of the other ranges for other regions.

In another embodiment, a cutter may have a back rake ranging from about 5 to 35 degrees. In a particular embodiment, the back rake angle of a rolling cutter may be >5 degrees, >10 degrees, >15 degrees, >20 degrees, >25 degrees, >30 degrees, and/or <10 degrees, <15 degrees, <20 degrees, <25, <30 degrees, <35 degrees, with any upper limit being used with any lower limit. Such back rake angles may be used in for rolling cutters in any of the cone, nose, shoulder or gage region of the bit, but in particular embodiments, a back rake of between 10 and 35 degrees (or 15 to 35 degrees or 20 to 30 degrees in more particular embodiments) may be particularly suitable for cutters in the nose and/or shoulder region of the bit. A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments, because the radial direction may assist the movement of a rotatable cutting element, such rotation may allow greater drill cuttings removal and provide an improved rate of penetration. One of ordinary skill in the art may realize that any back rake and side rake combination may be used with the cutting elements of the present disclosure to enhance rotatability and/or improve drilling efficiency.

As a rolling cutter contacts an earth formation, the rotating motion of the cutting element may be continuous or discontinuous. For example, when the cutting element is mounted with a determined side rake and back rake, the cutting force may be generally pointed in one direction. Providing a directional cutting force may allow the cutting element to have a continuous rotating motion, further enhancing drilling efficiency.

In accordance with the present disclosure, a plurality of rotatable cutting elements are disposed on a bit body utilizing two or more side rake angles, for example three or more side rake angles. In one or more embodiments, the two or more side rake angles may vary by at least 1 degree, for example at least 2 degrees (i.e., the difference between the greatest side rake and the least side rake) or at least 5 degrees. In one or more embodiments, the side rake angles of radially adjacent rotatable cutting elements may vary in the range of from 1 to 45 degrees, for example from 1 to 15 degrees, from 1 to 10 degrees, or from 1 to 5 degrees. In one or more embodiments, the side rake angles of radially adjacent rotatable cutting elements may vary by at least 2 degrees, for example at least 3. In one or more embodiments, the side rake angles of the radially adjacent rotatable cutting elements may vary in the range of from 2 to 10 degrees or from 2 to 5 degrees.

Figure 12A:
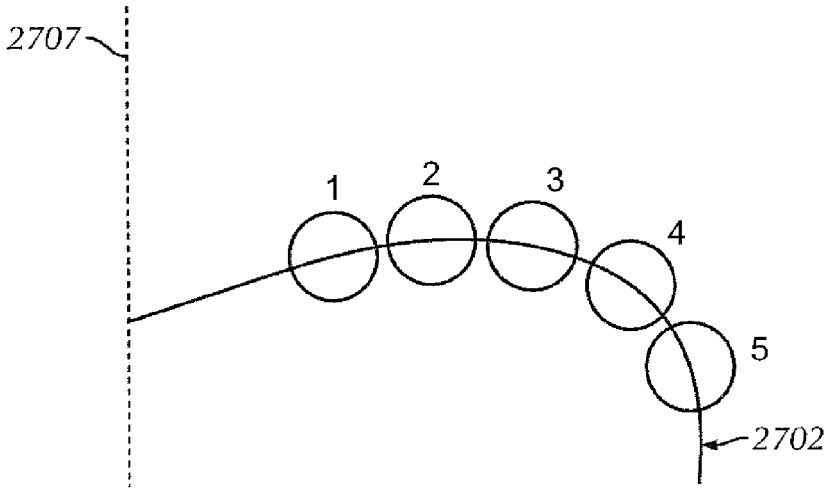
FIGS. 12A-D show a bit profile and corresponding graphs of the side rake angles of cutting elements on the bit.
Figure 12B:
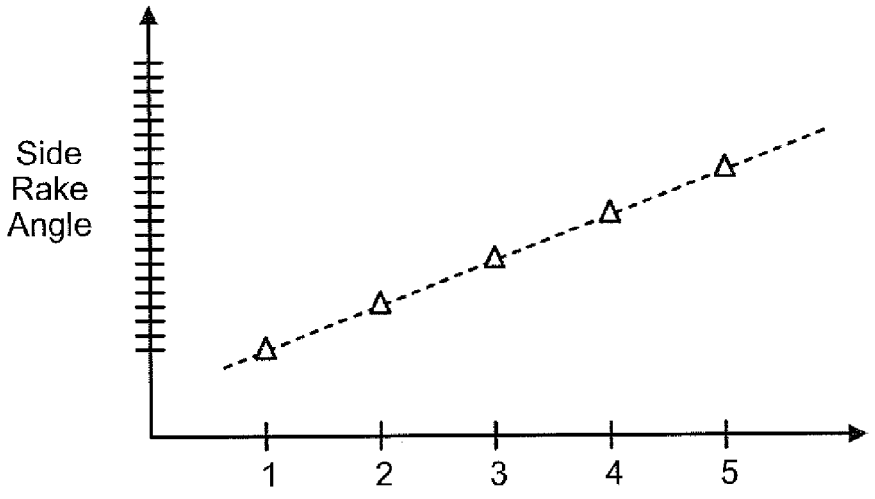

FIGS. 12A-D show an example of rolling cutters 1, 2, 3, 4, and 5 positioned on a bit blade 2702 and corresponding graphs of the side rake angles of each rolling cutter. As shown in FIG. 12B, the side rake angle of each rolling cutter 1, 2, 3, 4, 5 monotonically increases as the rolling cutters move farther from bit axis 2707. Advantageously, by monotonically increasing the side rake angles of rolling cutters in relation to the radial distance from the bit axis, the rolling cutters farther from the axis may have a faster rotating speed, and thus benefit more from the rotating motion. In one or more embodiments, the side rake angles of radially adjacent rotatable cutting elements may monotonically increase within the range of from 1 to 45 degrees, for example from 1 to 15 degrees, from 1 to 10 degrees, or from 1 to 5 degrees. In yet other embodiments, the side rake angles of radially adjacent rotatable cutting elements may monotonically increase within other variances of angles, for example greater than 45 degrees. In one or more embodiments, the side rake angles of radially adjacent rotatable cutting elements may monotonically increase by at least 2 degrees, for example at least 3. In one or more embodiments, the side rake angles of the radially adjacent rotatable cutting elements may monotonically increase in the range of from 2 to 10 degrees or from 2 to 5 degrees.

Figure 12C:
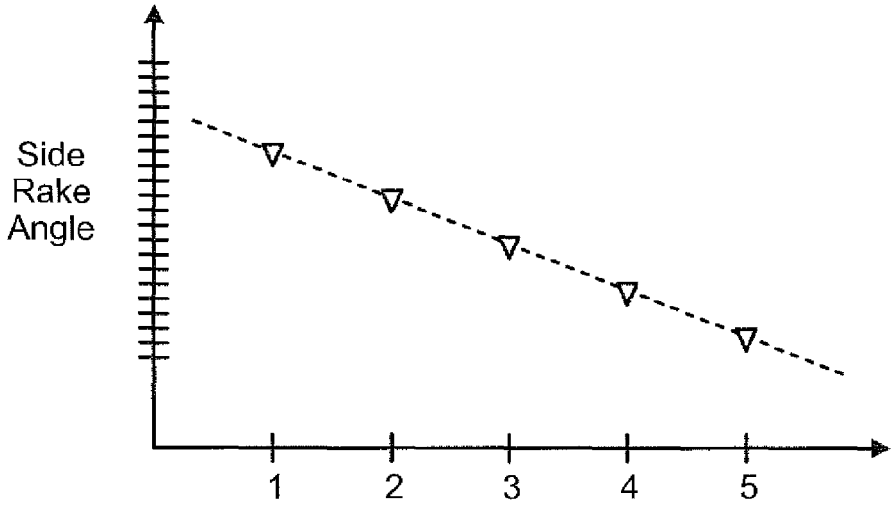

In another embodiment, as shown in FIG. 12C, the side rake angle of rolling cutters 1, 2, 3, 4, 5 may monotonically decrease as the cutters are farther from the bit axis. Advantageously, by monotonically decreasing the side rake angles of rolling cutters in relation to the radial distance from the bit axis, this can achieve relatively equal rotating speed on the rolling cutters and maintain similar wear to the elements surrounding the cutters. In one or more embodiments, the side rake angles of radially adjacent rotatable cutting elements may monotonically decrease within the range of from 45 to 1 degrees, for example from 15 to 1 degrees, from 10 to 1 degrees, or from 1 to 5 degrees. In yet other embodiments, the side rake angles of radially adjacent rotatable cutting elements may monotonically decrease within other variances of angles, for example greater than 45 degrees. In one or more embodiments, the side rake angles of radially adjacent rotatable cutting elements may monotonically decrease by at least 2 degrees, for example at least 3. In one or more embodiments, the side rake angles of the radially adjacent rotatable cutting elements may monotonically decrease in the range of from 2 to 10 degrees or from 2 to 5 degrees.

Figure 12D:
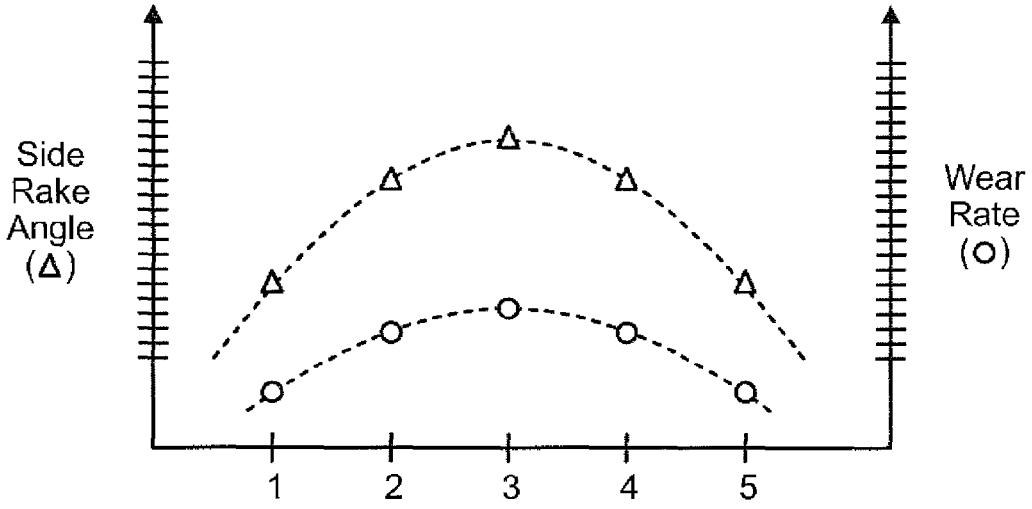

In yet another embodiment, as shown in FIG. 12D, the side rake angle of rolling cutters may correspond with the wear pattern on the blade cutting profile. For example, as the wear rate of cutting elements placed in a certain region of a bit blade increases, the side rake angle of the cutting elements may increase. Likewise, as the amount of wear experienced by cutting elements in certain regions of a bit blade decrease, the side rake angle of those cutting elements may be decreased. In one or more embodiments, the side rake angles of radially adjacent rotatable cutting elements may vary within the range of from 45 to 1 degrees, for example from 15 to 1 degrees, from 10 to 1 degrees, or from 1 to 5 degrees. In yet other embodiments, the side rake angles of radially adjacent rotatable cutting elements may vary within other variances of angles, for example greater than 45 degrees. In one or more embodiments, the side rake angles of radially adjacent rotatable cutting elements may vary by at least 2 degrees, for example at least 3. In one or more embodiments, the side rake angles of the radially adjacent rotatable cutting elements may vary in the range of from 2 to 10 degrees or from 2 to 5 degrees.

Bits having a plurality of rolling cutters of the present disclosure may include at least two rolling cutters, for example at least three, at least 4, at least 6, at least 9, or at least 12 rolling cutters, with any remaining cutting elements being conventional fixed cutting elements. In one or more embodiments, two or more primary blades may contain one or more rolling cutters, for example each primary blade may contain one or more rolling cutters. In one or more additional embodiments, one or more secondary blades may also contain one or more rolling cutters, for example each secondary blade may contain one or more rolling cutters. In one or more embodiments, all cutting elements may be rotatable.

Figure 13:
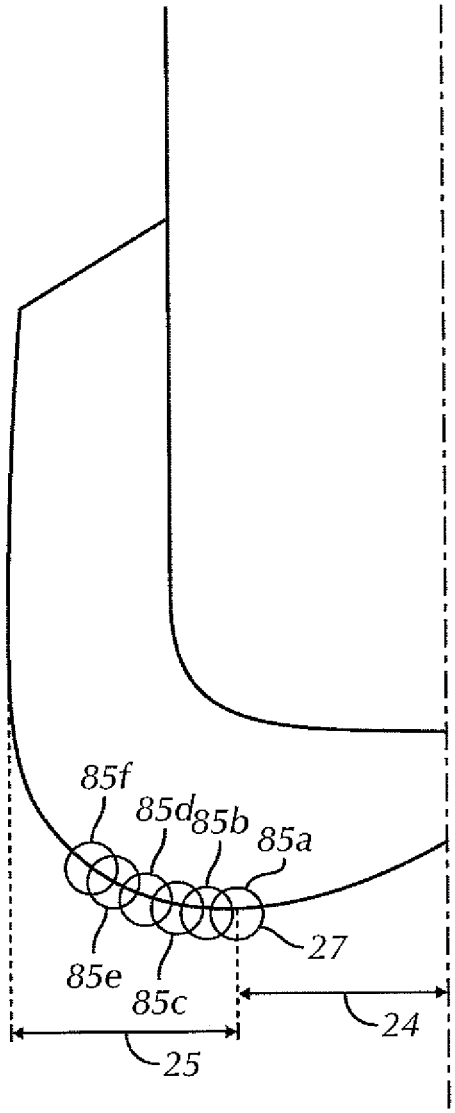
FIG. 13 shows a partial cross-sectional view of a drag bit illustrating only the rotatable cutting elements rotated into a single profile.

FIG. 13 illustrates an exemplary partial rotated profile of a drag bit shown as it would appear with all blades and only the rolling cutters rotated into a single rotated profile (the fixed cutting elements excluded). As shown in FIG. 13, rolling cutters 85*a*-85*f* are each positioned at a unique radial position within the nose 27 and shoulder area 25. Rolling cutter 85*a* has a side rake angle of 20 degrees and a back rake angle of 24 degrees. Rolling cutter 85*b* has a side rake angle of 25 degrees and a back rake angle of 24 degrees. Rolling cutter 85*c* has a side rake angle of 25 degrees and a back rake angle of 24 degrees. Rolling cutter 85*d* has a side rake angle of 22 degrees and a back rake angle of 24 degrees. Rolling cutter 85*e* has a side rake angle of 25 degrees and a back rake angle of 25 degrees. Rolling cutter 85*f* has a side rake angle of 22 degrees and a back rake angle of 25 degrees.

In other exemplary embodiments, different types of rolling cutters may be used to provide increased design freedom. For example, rolling cutters that do not have an outer shell may take up less space on a downhole cutting tool, and therefore, more of the rolling cutters without a shell may be placed on the cutting tool, which may provide an increased diamond cutting density. Further, using rolling cutters without an outer shell may provide more space on the cutting tool for higher side rake angles. For example, rolling cutters without an outer shell may be positioned on a cutting tool, wherein the rolling cutters each have a side rake angle ranging between 0 and 40 degrees.

In one or more embodiments, one or more first rolling cutters may be mounted on one or more primary blades at a first side rake angle and one or more second rolling cutters may be mounted on one or more secondary blades at a second side rake angle which second side rake angle differs from the first side rake angle by at least 2 degrees. In one or more embodiments, a third rolling cutter may be mounted on another of the primary blades having a different side rake angle from the one or more first rolling cutters. In one or more embodiment, a fourth rolling cutter may be mounted on another of the secondary blades having a different side rake angle from the one or more second rolling cutters. In one or more embodiments, the first, second, third, and fourth rolling cutters may be the same rolling cutters with different side rake angles and optionally different back rake angles. Alternatively, one r more of the first, second, third and fourth rolling cutters may use two or more different rolling cutter devices.

In alternate embodiments, cutting elements may be disposed in cutting tools that do not incorporate back rake and/or side rake. When the cutting element is disposed on a drill bit with substantially zero degrees of side rake and/or back rake, the cutting force may be random instead of pointing in one general direction. The random forces may cause the cutting element to have a discontinuous rotating motion. Generally, such a discontinuous motion may not provide the most efficient drilling condition, however, in certain embodiments, it may be beneficial to allow substantially the entire cutting surface of the insert to contact the formation in a relatively even manner. In such an embodiment, alternative inner rotatable cutting element and/or cutting surface designs may be used to further exploit the benefits of rotatable cutting elements.

According to some embodiments, the extension height of cutting element cutting faces (i.e., the upper surface of the cutting table of the cutting element) may vary. In an example embodiment, cutting faces of primary cutting elements may have a greater extension height than the cutting faces of backup cutting elements (i.e., "on-profile" primary cutting elements engage a greater depth of the formation than the backup cutting elements; and the backup cutting elements are "off-profile"). As used herein, the term "off-profile" may be used to refer to a structure extending from the cutter-supporting surface (e.g., the cutting element, depth-of-cut limiter, etc.) that has an extension height less than the extension height of one or more other cutting elements that define the outermost cutting profile of a given blade. As used herein, the term "extension height" is used to describe the distance a cutting face extends from the cutter-supporting surface of the blade to which it is attached. In some example embodiments, one or more backup cutting faces may have the same or a greater extension height than one or more primary cutting faces. Such variables may impact the properties of the BHA, in particular the drill bit, which can affect the arrangement or positioning of the different types of cutting elements. For example, "on-profile" cutting elements may experience a greater amount of wear and load than "off-profile" cutting elements. Also, primary cutting elements may experience a greater amount of wear and load than backup cutting elements.

Exemplary Embodiments of Rolling Cutters

Rolling cutters of the present disclosure may include various types and sizes of rolling cutters. For example, rolling cutters may be formed in sizes including, but not limited to, 9 mm, 13 mm, 16 mm, and 19 mm. Further, rolling cutters may include those held within an outer support element, held by a retention mechanism or blocker, or a combination of the two. Examples of rolling cutters that may be used in the present disclosure may be found at least in U.S. Publication No. 2007/0278017 and U.S. Provisional Application No. 61/351,035, which are hereby incorporated by reference. Exemplary embodiments of rolling cutters are also described below; however, the types of rotatable cutting elements that may be used with the present disclosure are not necessarily limited to those described below.

Figure 1A:
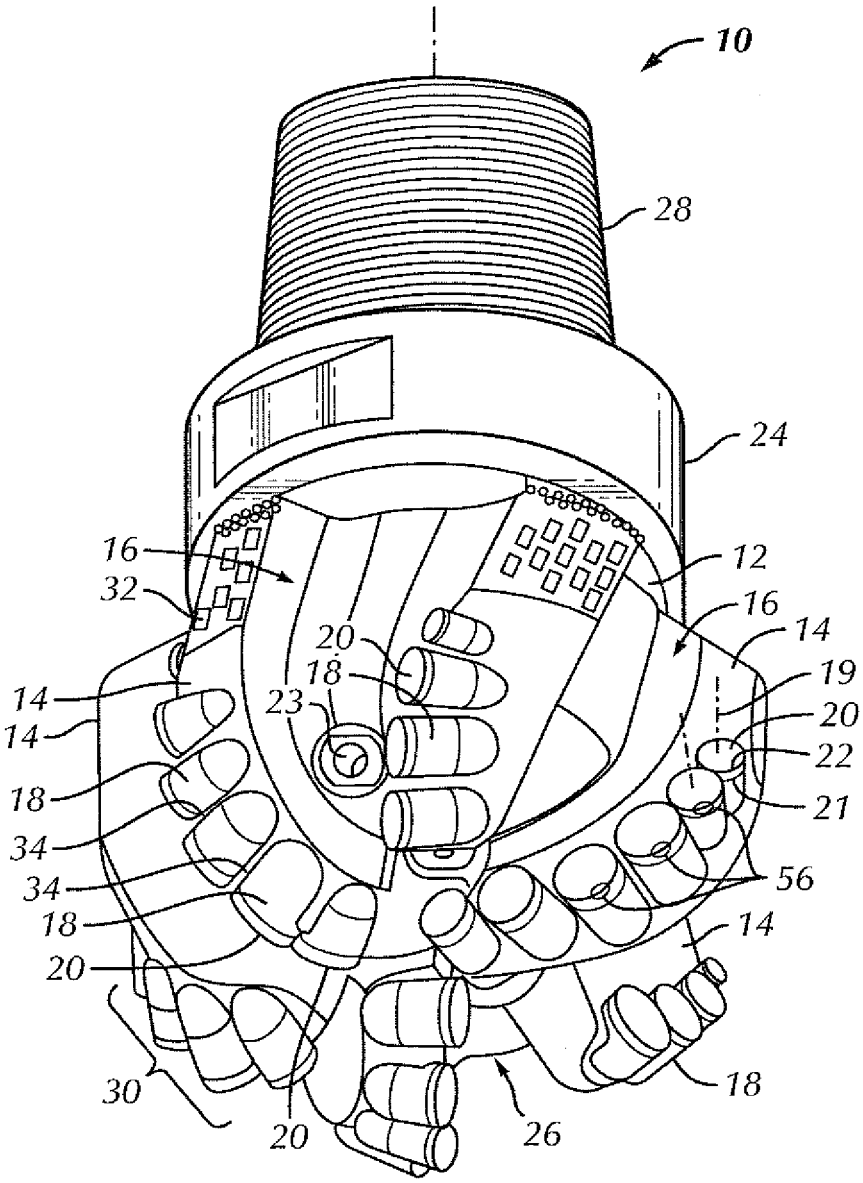
FIG. 1A shows a perspective view of a conventional fixed cutter bit.
Figure 1B:
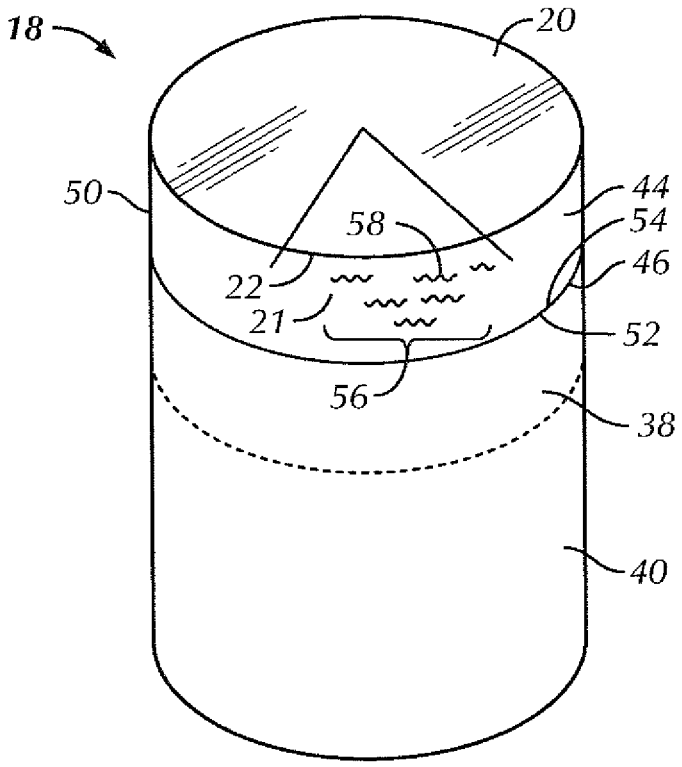
FIG. 1B shows a perspective view of a conventional PDC cutter.
Figure 2A:
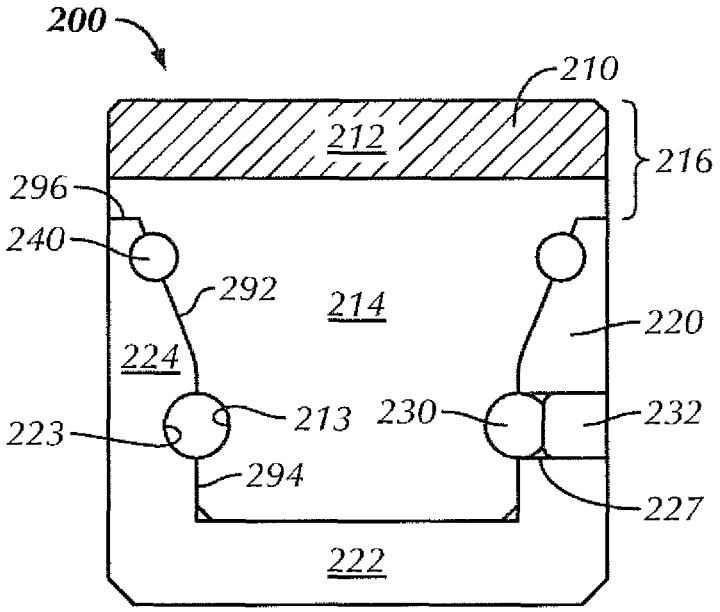
FIG. 2A-B show a schematic of a cutting element according to one embodiment disclosed herein.
Figure 2B:
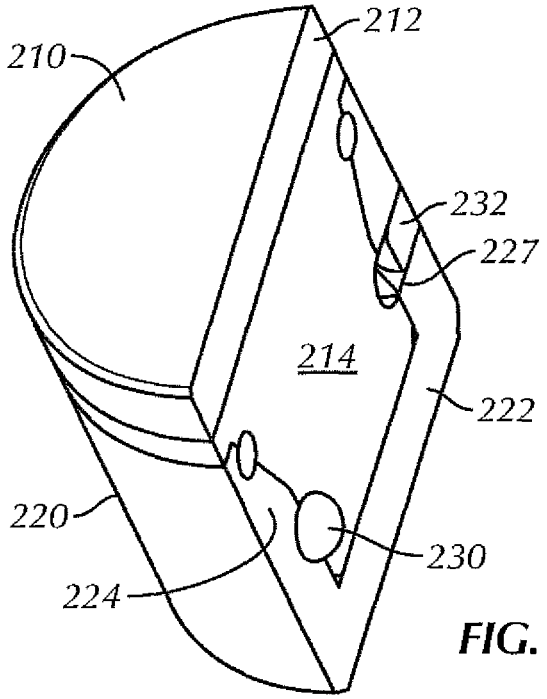

Referring to FIG. 2A-B, a cutting element in accordance with one embodiment of the present disclosure is shown. As shown in this embodiment, cutting element 200 includes an inner rotatable (dynamic) cutting element 210 which is partially disposed in, and thus, partially surrounded by an outer support (static) element 220. Outer support element 220 includes a bottom portion 222 and a side portion 224. Inner rotatable cutting element 210, partially disposed within the cavity defined by the bottom portion 222 and side portion 224, includes a cutting face 212 portion disposed on an upper surface of substrate 214. Additionally, while bottom portion 222 and side portion 224 of the outer support element 220 are shown in FIG. 2 as being integral, one of ordinary skill in the art would appreciate that depending on the geometry of the cutting element components, the bottom and side portions may alternatively be two separate pieces bonded together. In yet another embodiment, the outer support element 220 may be formed from two separate pieces bonded together on a vertical plane (with respect to the cutting element axis, for example) to surround at least a portion of the inner rotatable cutting element 210.

In various embodiments, the cutting face of the inner rotatable cutting element may include an ultra hard layer that may be comprised of a polycrystalline diamond table, a thermally stable diamond layer (i.e., having a thermal stability greater than that of conventional polycrystalline diamond, 750° C.), or other ultra hard layer such as a cubic boron nitride layer.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be preferable to have a single diamond composite forming the cutting face and substrate or distinct layers.

The outer support element may be formed from a variety of materials. In one embodiment, the outer support element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent.

In other embodiments, the outer support element may be formed of alloy steels, nickel-based alloys, and cobalt-based alloys. One of ordinary skill in the art would also recognize that cutting element components may be coated with a hard-facing material for increased erosion protection. Such coatings may be applied by various techniques known in the art such as, for example, detonation gun (d-gun) and spray-and-fuse techniques.

Referring again to FIG. 2A, as the inner rotatable cutting element 210 is only partially disposed in and/or surrounded by the outer support element 220, at least a portion of the inner rotatable cutting element 210 may be referred to as an "exposed portion" 216 of the inner rotatable cutting element 210. Depending on the thickness of the exposed portion 216, exposed portion 216 may include at least a portion of the cutting face 212 or the cutting face 212 and a portion of the substrate 214. As shown in FIG. 2, exposed portion 216 includes cutting face 212 and a portion of substrate 214. However, one of ordinary skill in the art would recognize that while the exposed portion 216 is shown as being constant across the entire diameter or width of the inner rotatable cutting element 210, in the embodiment shown in FIG. 2, depending on the geometry of the cutting element components, the exposed portion 216 of the inner rotatable cutting element 210 may vary, as demonstrated by some of the figures described below.

In a particular embodiment, the cutting face of the inner rotatable cutting element has a thickness of at least 0.050 inches. However, one of ordinary skill in the art would recognize that depending on the geometry and size of the cutting structure, other thicknesses may be appropriate.

In another embodiment, the inner rotatable cutting element may have a non-planar interface between the substrate and the cutting face. A non-planar interface between the substrate and cutting face increases the surface area of a substrate, thus may improve the bonding of the cutting face to the substrate. In addition, the non-planar interfaces may increase the resistance to shear stress that often results in delamination of the diamond tables, for example.

One example of a non-planar interface between a carbide substrate and a diamond layer is described, for example, in U.S. Pat. No. 5,662,720, wherein an "egg-carton" shape is formed into the substrate by a suitable cutting, etching, or molding process. Other non-planar interfaces may also be used including, for example, the interface described in U.S. Pat. No. 5,494,477. According to one embodiment of the present disclosure, a cutting face is deposited onto the substrate having a non-planar surface.

An inner rotatable cutting element may be retained in the outer support element by a variety of mechanisms, including for example, ball bearings, pins, and mechanical interlocking. In various embodiments, a single retention system may be used, while, alternatively, in other embodiments, multiple retention systems may be used.

Referring again to FIGS. 2A-2B, cutting elements having a ball bearing retention system are shown. As shown in these embodiments, inner rotatable cutting element 210 and outer support element 220 include substantially aligned/matching grooves 213 and 223 in the side surface of the substrate 214 and inner surface of the side portion 224, respectively. Occupying the space defined by grooves 213 and 223, are retention balls (i.e., ball bearings) 230 to assist in retaining inner rotatable cutting element 210 in outer support element 220. Balls may be inserted through pinhole 227 in side portion 224. In such an embodiment, following assembly of the cutting element 200, pinhole 227 may be sealed with a pin or plug 232 or any other material capable of filling pinhole 227 without impairing the function of retention balls/bearings 230. In alternative embodiments, cutting element 200 may be formed from multiple pieces as described above such that pinhole 227 and plug 232 are not required.

Balls 230 may be made any material (e.g., steel or carbides) capable of withstanding compressive forces acting thereupon while cutting element 200 engages the formation. In a particular embodiment the balls may be formed of tungsten carbide or silicon carbide. If tungsten carbide balls are used, it may be preferable to use a cemented tungsten carbide composition varying from that of the outer support element and/or substrate. Balls 230 may be of any size and of which may be variable to change the rotational speed of inner rotatable cutting element 210. In certain embodiments, the rotatable speed of dynamic portion 210 may be between one and five rotations per minute so that the surface of cutting face 212 may remain sharp without compromising the integrity of cutting element 200.

Figure 3A:
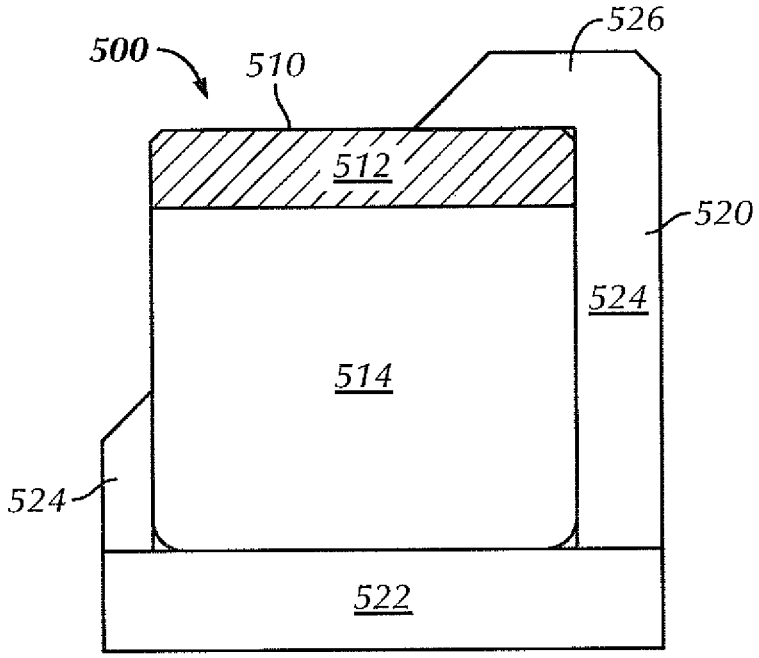
FIGS. 3A-B show a schematic of a cutting element according to one embodiment disclosed herein.
Figure 3B:
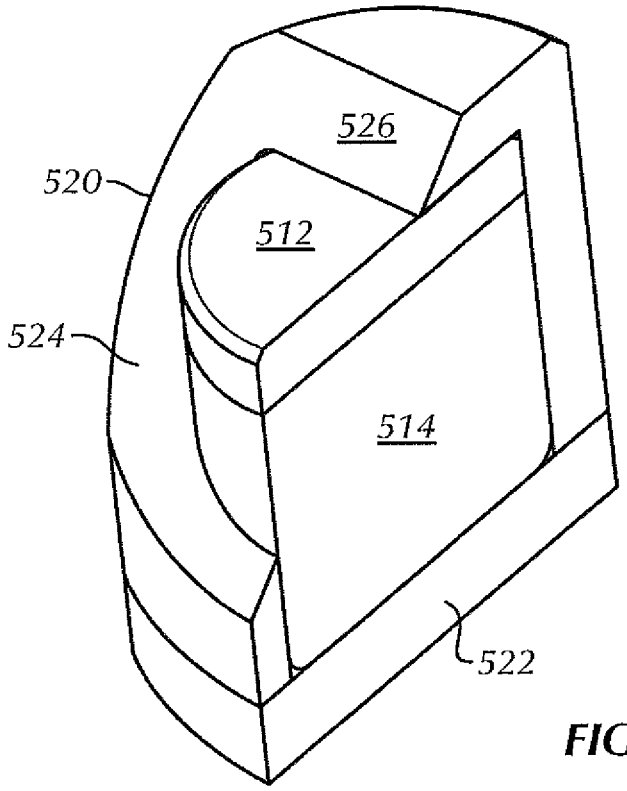

Referring to FIGS. 3A-B, a cutting element having a mechanical interlocking retention system is shown. As shown in this embodiment, cutting element 500 includes an inner rotatable (dynamic) cutting element 510 which is partially disposed in and thus, partially surrounded by an outer support (static) element 520. Outer support element 520 includes a bottom portion 522, a side portion 524, and a top portion 526. Inner rotatable cutting element 510 includes a cutting face 512 portion disposed on an upper surface of substrate 514. Inner rotatable cutting element is disposed within the cavity defined by the bottom portion 522, side portion 524, and top portion 526. Due to the structural nature of this embodiment, inner rotatable cutting element is mechanically retained in the outer support element 520 cavity by bottom portion 522, side portion 524, and top portion 526. As shown in FIG. 3, top portion 526 extends partially over the upper surface of cutting face 512 so as to retain inner rotatable cutting element 510 and also allow for cutting of a formation by the inner rotatable cutting element 510, and specifically, cutting face 512.

In various embodiments including, for example, those shown in FIGS. 2A-B above, the cutting elements disclosed herein may include a seal between the inner rotatable cutting element and the outer support element. As shown in FIGS. 2A-B, a seal or sealing element 240 is disposed between inner rotatable cutting element 210 and outer support element 220, specifically, on the conical surface of the inner rotatable cutting element 210. Sealing element 240 may be provided, in one embodiment, to reduce contact between the inner rotatable cutting element 210 and the outer support element 220 and may be made from any number of materials (e.g., rubbers, elastomers, and polymers) known to one of ordinary skill in the art. As such, sealing element 240 may reduce heat generated by friction as inner rotatable cutting element 210 rotates within outer support element 220. Further, sealing element 240 may also act to reduce galling or seizure of bearings 230 or pin due to mud infusion or compaction of drill cuttings. In optional embodiments, grease, or any other friction reducing material may be added in the seal groove between inner rotatable cutting element 210 and outer support element 220. Such material may prevent the build-up of heat between the components, thereby extending the life of cutting element 200.

In one embodiment, the bearing surfaces of the cutting elements disclosed herein may be enhanced to promote rotation of the inner rotatable cutting element in the outer support element. Bearing surface enhancements may be incorporated on a portion of either or both of the inner rotatable cutting element bearing surface and outer support element bearing surface. In a particular embodiment, at least a portion of one of the bearing surfaces may include a diamond bearing surface. According to the present disclosed, a diamond bearing surface may include discrete segments of diamond in some embodiments and a continuous segment in other embodiments. Bearing surfaces that may be used in the cutting elements disclosed herein may include diamond bearing surfaces, such as those disclosed in U.S. Pat. Nos. 4,756,631 and 4,738,322, assigned to the present assignee and incorporated herein by reference in its entirety.

In some embodiments, diamond-on-diamond bearing surfaces may be provided. This may be achieved by using diamond enhanced bearing surfaces on both the inner rotatable cutting element and outer support element, or alternatively, the substrate may be formed of diamond and diamond enhanced bearing surfaces may be provided on the outer support element. In other embodiments, diamond-on-carbide bearing surfaces may be used, where diamond bearing surfaces may be included on one of the substrate or the outer support element, where carbide comprises the other component.

To further enhance rotation of the inner rotatable cutting element, the bottom mating surfaces of the inner rotatable cutting element and outer support element may be varied. For example, ball bearings may be provided between the two components or, alternatively, one of the surfaces may contain and/or be formed of diamond.

In another embodiment, at least a portion of at least one of the bearing surfaces may be surface treated for optimizing the rotation of the inner rotatable cutting element in the inner support element. Surface treatments suitable for the cutting elements of the present disclosure include addition of a lubricant, applied coatings and surface finishing, for example. In a particular embodiment, a bearing surface may undergo surface finishing such that the surface has a mean roughness of less than about 125 μ-inch Ra, and less than about 32 μ-inch Ra in another embodiment. In another particular embodiment, a bearing surface may be coated with a lubricious material to facilitate rotation of the inner rotatable cutting element and/or to reduce friction and galling between the inner rotatable cutting element and the outer support element. In a particular embodiment, a bearing surface may be coated with a carbide, nitride, and/or oxide of various metals that may be applied by PVD, CVD or any other deposition techniques known in the art that facilitate bonding to the substrate or base material. In another embodiment, a floating bearing may be included between the bearing surfaces to facilitate rotation. Incorporation of a friction reducing material, such as a grease or lubricant, may allow the surfaces of the inner rotatable cutting element and the outer support element to rotate and contract one another, but result in only minimal heat generation therefrom.

In another embodiment, surface alterations may be included on the working surfaces of the cutting face, the substrate, and/or an inner hole of the inner rotatable cutting element. Surface alterations may be included in the cutting elements of the present disclosure to enhance rotation through hydraulic interactions or physical interactions with the formation. In various embodiments, surface alterations may be etched or machined into the various components, or alternatively formed during sintering or formation of the component, and in some particular embodiments, may have a depth ranging from 0.001 to 0.050 inches. One of ordinary skill in the art would recognize the surface alterations may take any geometric or non-geometric shape on any portion of the inner rotatable cutting element and may be formed in a symmetric or asymmetric manner. Further, depending on the size of the cutting elements, it may be preferable to vary the depth of the surface alterations.

While the above embodiments describe surface alterations formed, for example, by etching or machining, it is also within the scope of the present disclosure that the cutting element includes a non-planar cutting face that may be achieved through protrusions from the face. Non-planar cutting faces may also be achieved through the use of shaped cutting faces in the inner rotatable cutting element. For example, shaped cutting faces suitable for use in the cutting elements of the present disclosure may include domed or rounded tops and saddle shapes.

Further, the types of bearing surfaces between the inner rotatable cutting element and outer support elements present in a particular cutting element may vary. Among the types of bearing surfaces that may be present in the cutting elements of the present disclosure include conical bearing surfaces, radial bearing surfaces, and axial bearing surfaces.

In one embodiment, the inner rotatable cutting element may of a generally frusto-conical shape within an outer support element having a substantially mating shape, such that the inner rotatable cutting element and outer support element have conical bearing surfaces therebetween. Referring to FIGS. 2A-B, such an embodiment with conical bearing surfaces is shown. As shown in this embodiment, conical bearing surfaces 292 between the inner rotatable cutting element 210 and outer support element 220 may serve to take a large portion of the thrust from the rotating inner rotatable cutting element 210 during operation as it interacts with a formation. Further, in applications needing a more robust cutting element, a conical bearing surface may provide a larger area for the applied load. The embodiment shown in FIG. 2A-B also shows a radial bearing surface 294 and an axial bearing surface 296.

Figure 4:
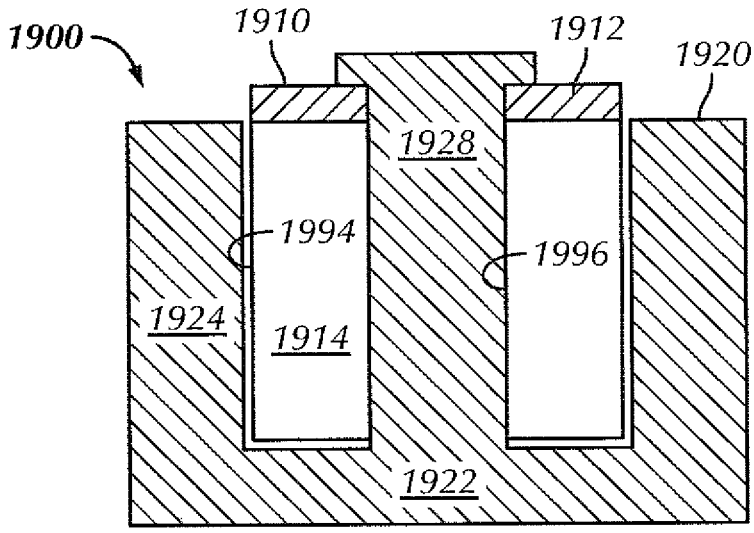
FIG. 4 shows a schematic of a cutting element according to one embodiment disclosed herein.

Referring to FIG. 4, a cutting element according to another embodiment is shown. As shown in this embodiment, cutting element 1900 includes an inner rotatable (dynamic) cutting element 1910 which is partially disposed in, and thus, partially surrounded by an outer support (static element) 1920. Outer support element 1920 includes a bottom portion 1922 and a side portion 1924. Inner rotatable cutting element 1910 includes a cutting face 1912 portion disposed on an upper surface of substrate 1914. As shown in this embodiment, outer support element 1920 is integral with a bit body (not shown). In alternative embodiments, outer support element 1920 may be a discrete element. As also shown in this embodiment, outer support element 1920 also includes a inner shaft portion 1928 threadedly attached to and extending from bottom portion 1922 into substrate 1914 of inner rotatable cutting element 1910 such that when inner rotatable cutting element 1910 rotates, it rotates within side portion 1924 and about inner shaft portion 1928 of outer support element 1920. In alternative embodiments, inner shaft portion 1928 may be integral with bottom portion 1922. Upper end of inner shaft portion 1928 extends partially over the cutting face 1912 of the inner rotatable cutting element 1910 to assist in retaining the inner rotatable cutting element 1910 within the outer support element 1920.

As shown in the various illustrated above, the inner rotatable cutting element and outer support cutting element may take the form of a variety of shapes/geometries. Depending on the shapes of the components, different bearings surfaces, or combinations thereof may exist between the inner rotatable cutting element and outer support element. However, one of ordinary skill in the art would recognize that permutations in the shapes may exist and any particular geometric forms should not be considered a limitation on the scope of the cutting elements disclosed herein.

Further, one of ordinary skill in the art would also appreciate that any of the design modifications as described above, including, for example, side rake, back rake, variations in geometry, surface alteration/etching, seals, bearings, material compositions, etc, may be included in various combinations not limited to those described above in the cutting elements of the present disclosure.

The cutting elements of the present disclosure may be incorporated in various types of downhole cutting tools, including for example, as cutters in fixed cutter bits or as inserts in roller cone bits, reamers, hole benders, or any other tool that may be used to drill earthen formations. Cutting tools having the cutting elements of the present disclosure may include a single rotatable cutting element with the remaining cutting elements being conventional cutting elements, all cutting elements being rotatable, or any combination therebetween of rotatable and conventional cutting elements.

Figure 5:
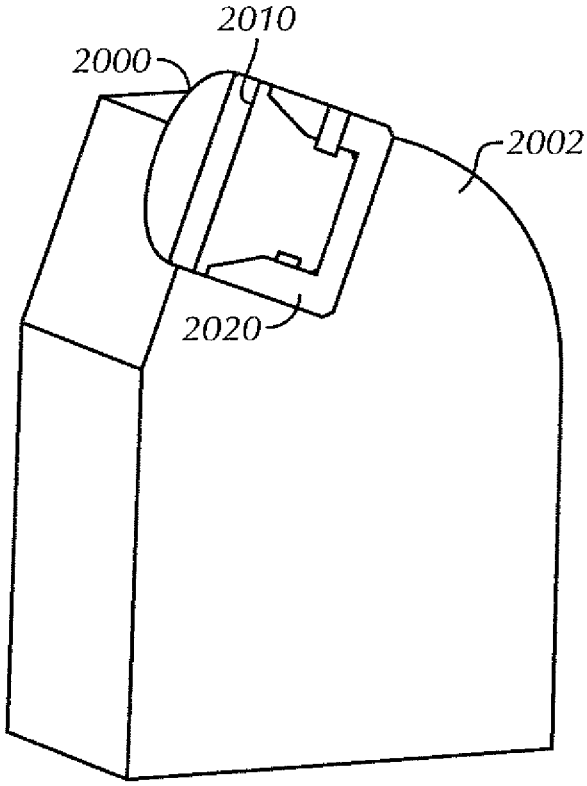
FIG. 5 shows a schematic of a cutting element on a blade according to one embodiment disclosed herein.

Referring now to FIG. 5, a cutting element 2000 disposed on a blade 2002, in accordance with an embodiment of the present disclosure, is shown. In this embodiment, cutting element 2000 includes an inner rotatable cutting element 2010 partially disposed in outer support element 2020. To vary the cutting action and potentially change the cutting efficiency and rotation, one of ordinary skill in the art should understand that the back rake (i.e., a vertical orientation) and the side rake (i.e., a lateral orientation) of the cutting element 2000 may be adjusted, as described above.

Figure 6:
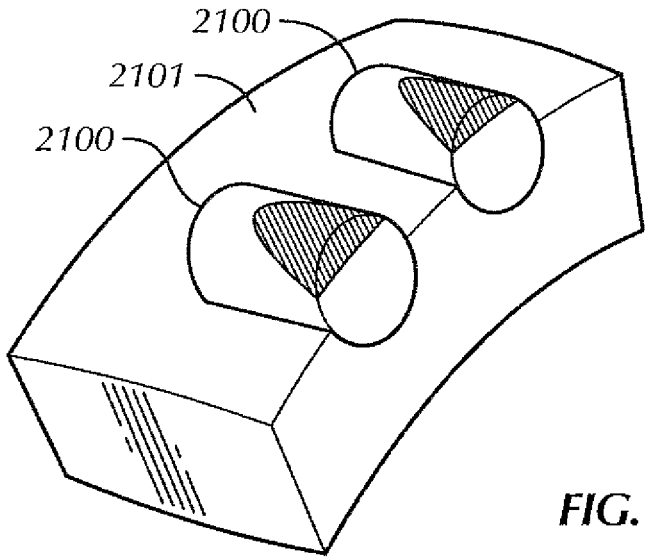
FIG. 6 shows a bit profile according to one embodiment disclosed herein.

The cutting elements of the present disclosure may be attached to or mounted on a drill bit by a variety of mechanisms, including but not limited to conventional attachment or brazing techniques in a cutter pocket. One alternative mounting technique that may be suitable for the cutting elements of the present disclosure is shown in FIG. 6. As shown in this embodiment, cutting elements 2100 are mounted in an assembly 2101, which may be mounted on a bit body (not shown) by means such as mechanical, brazing, or combinations thereof. It is also within the scope of the present disclosure that in some embodiments, an inner rotatable cutting element may be mounted on the bit directly such that the bit body acts as the outer support element, i.e., by inserting the inner rotatable cutting element into a hole that may be subsequently blocked to retain the inner rotatable cutting element within.

Figure 7A:
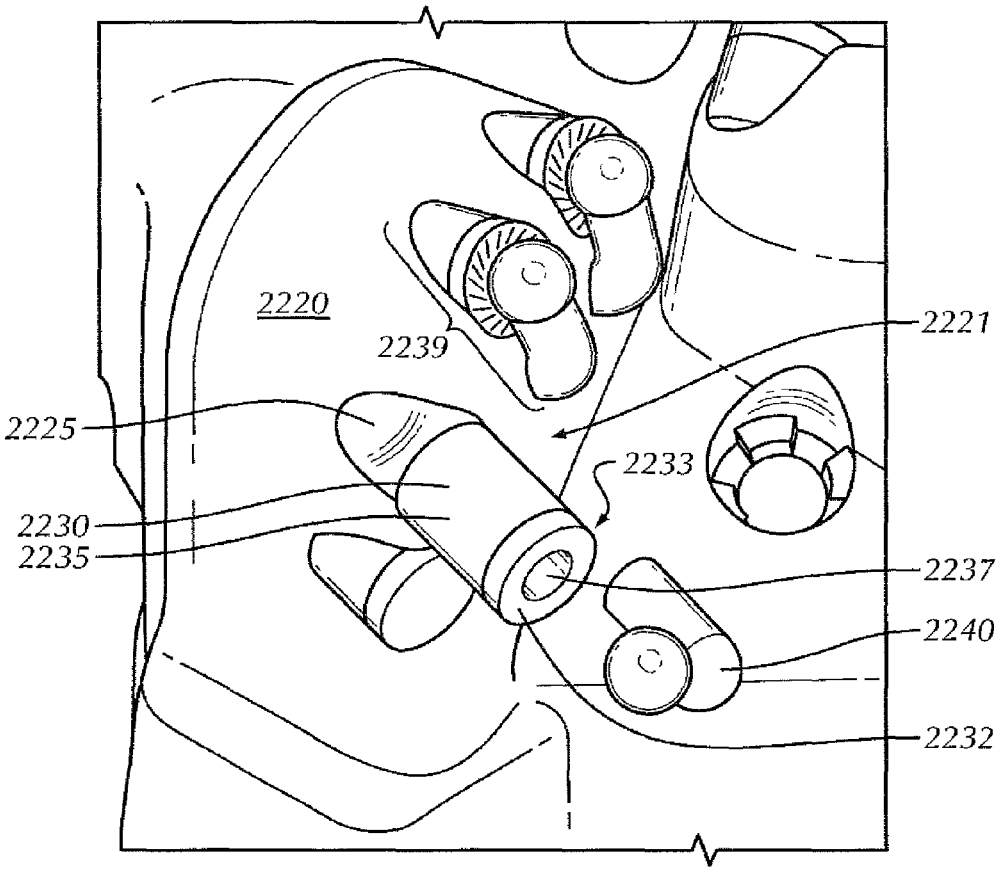
FIGS. 7A-C show an expanded view and cross-sectional views of cutting element assemblies according to embodiments disclosed herein.
Figure 7B:
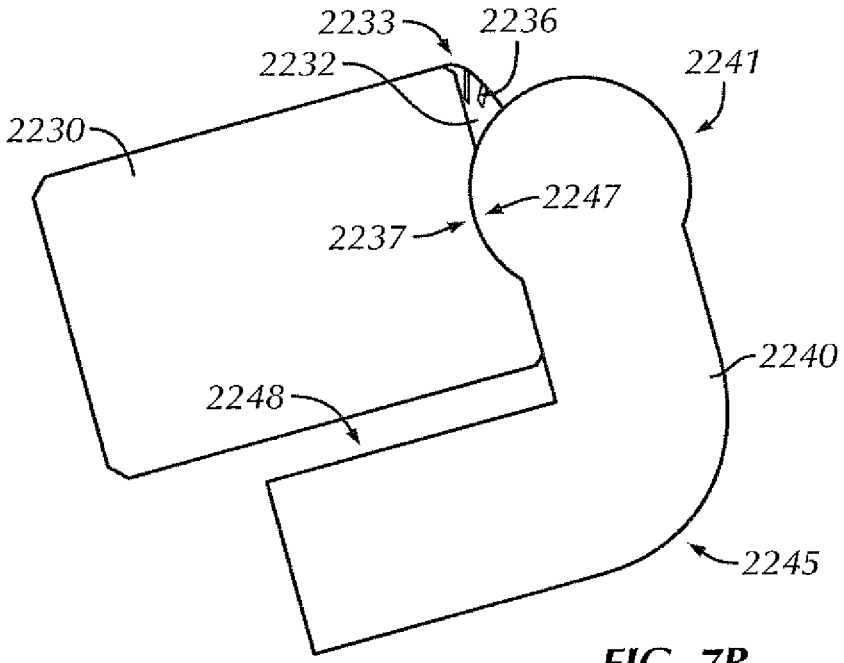

Referring to FIGS. 7A-B, a rolling cutter 2239 including a rolling cutter 2230 and a blocker 2240 is shown. The rolling cutter 2230 may have a cylindrical body as a substrate 2231, which may be formed from cemented carbide such as tungsten carbide. A cutting face 2232 may be formed on one end of the rolling cutter 2230, wherein the cutting face 2232 is the end of the rolling cutter 2230 that faces a corresponding blocker 2240 and that contacts formation in a wellbore. The cutting face 2232 may be made from any number of hard and/or wear resistant materials, including, for example, tungsten carbide, polycrystalline diamond, and thermally stable polycrystalline diamond. Further, the cutting face 2232 may be made from a material that is different from the substrate or the same as the substrate 2231. For example, a rolling cutter may have a cutting face made from a material different from the substrate material, such as a diamond table disposed on the upper surface of a carbide substrate, such that the diamond table forms the cutting face of the rolling cutter. Alternatively, some embodiments may have a substrate and a cutting face made of the same material. For example, a rolling cutter may be formed entirely of diamond, such that the substrate and the cutting face are made of diamond. In such embodiments, the diamond may be fully or partially leached. In another exemplary embodiment of a rolling cutter having a substrate and cutting face made of the same material, the rolling cutter substrate may be made of a carbide material, wherein the upper surface of the carbide substrate forms the cutting face.

The rolling cutter 2230 may also have a side surface 2235 formed around the circumference and extending the entire length of the rolling cutter 2230. Thus, in embodiments having a cutting face made from a material that is different from the substrate, the side surface may include both substrate material and the cutting face material. Further, as shown in FIGS. 7A and 7B, a cutting edge 2233 is formed at the intersection of the cutting face 2232 and the side surface 2235. The cutting edge may be formed from material that is the same as the substrate material or different from the substrate material. For example, the cutting edge may be formed from tungsten carbide, polycrystalline diamond, TSP, or other hard and/or wear resistant materials known in the art.

Figure 7C:
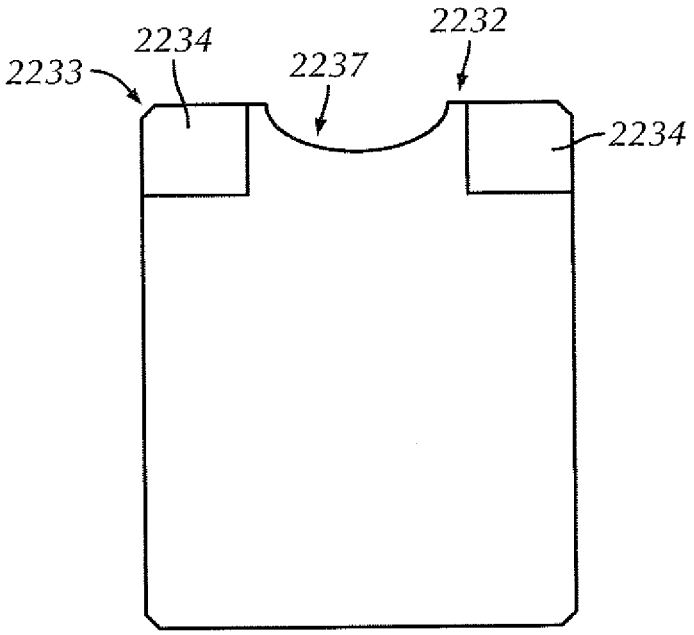

Further, the rolling cutter may be modified to have diamond material (e.g., polycrystalline diamond) at the cutting face and/or the cutting edge. A rolling cutter 2230 having a cutting edge 2233 of polycrystalline diamond 2234, as shown in FIG. 7C, may have a carbide material (e.g., tungsten carbide) exposed on a portion of the cutting face 2232 to enable easy and precise machining of the rolling cutter 2230 to mate with a corresponding shaped retention end of a blocker. For example, FIG. 7C shows the exposed carbide portion of the cutting face having a concave portion 2237. In other embodiments, the cutting face of a rolling cutter may be substantially planar.

Referring to FIGS. 7A-B, the rolling cutter 2230 may be modified to have at least one groove 2236 formed within the cutting face 2232, the cutting edge 2233, and/or the side surface 2235. Grooves 2236 may be included in the rolling cutters of the present disclosure to enhance rotation through hydraulic interactions or physical interactions with the formation. In various embodiments, grooves 2236 may be etched or machined into the various components, or alternatively formed during sintering or formation of the component, and in some particular embodiments, may have a depth ranging from 0.001 to 0.050 inches. One of ordinary skill in the art would recognize the grooves may take any geometric or non-geometric shape and depending on the size of the cutting elements, it may be preferable to vary the depth of the grooves. Other features aiming to increase the drag force to rotate the cutter, such as holes, dimples, or raised volumes on the cutting face, chamfer or side surface, are all within the scope of the invention. Further, grooves may be formed in a symmetric or asymmetric manner around the longitudinal axis of the rolling cutter. For example, FIG. 7A shows a rolling cutter having grooves 2236 formed axisymmetrically in the cutting face 2232 near the cutting edge 2233.

In addition to grooves, the cutting face 2232 of a rolling cutter 2230 may have a concave or convex portion. The terms "concave portion" and "convex portion" refer to a portion of a cutting face that has a concave or convex shape and is configured to correspond with an adjacent blocker. Although a concave portion may have a shape similar to or the same as the shape of a groove 2236, a concave/convex portion differs in function and typically in size and location from grooves. In particular, a concave/convex portion may be formed to fit with the retention end of a corresponding blocker and may be generally located in the radial center of a cutting face. Grooves may be formed around or near the edges of a cutting face to enhance rotation of the rolling cutter and are generally smaller than a concave/convex portion.

An example of a rolling cutter having both grooves and a concave portion is shown in FIGS. 7A-B to further clarify the differences between a groove and concave portion. In the embodiment shown in FIGS. 7A-B, a rolling cutter 2230 has a concave portion 2237 formed at or near the radial center of the cutting face 2232 and smaller-sized grooves 2236 formed around the cutting face 2232 near the cutting edge 2233. A blocker 2240 positioned adjacent to the rolling cutter 2230 on the leading face 2221 of the blade 2220 may include a retention end 2241 and an attachment end 2245, wherein the retention end 2241 is positioned adjacent to the concave portion 2237 of the cutting face 2232 of the rolling cutter 2230 to retain the rolling cutter in the cutter pocket 2225, and wherein the attachment end 2245 is attached to a portion of the blade 2220. Attachment end 2245 may include an upper surface 2248, which extends into a portion of the blade and beneath the rolling cutter 2230. As shown in FIGS. 7A-B, the retention end 2241 of the blocker 2240 may have a convex portion 2247, wherein the convex portion 2247 mates with the concave portion 2237 of the rolling cutter 2230. Alternatively, in other embodiments, the cutting face may have a convex portion and the retention end of a blocker may have a concave portion such that the convex portion of the cutting face mates with the concave portion of the retention end.

As referred to herein, a blocker is a component separate from a bit that is attached to the bit, adjacent to the cutting face of a rolling cutter. A blocker includes an attachment end, which acts as an attachment between the blocker and the bit, and a retention end, which is located adjacent to the cutting face of a rolling cutter. A blocker may be formed from various materials and have various shapes and sizes to prevent the rolling cutter from coming out of a cutter pocket formed in the bit.

Advantageously, embodiments disclosed herein may provide for at least one of the following. Cutting elements that include a rotatable cutting portion may avoid the high temperatures generated by typical fixed cutters. Because the cutting surface of prior art cutting elements is constantly contacting formation, heat may build-up that may cause failure of the cutting element due to fracture. Embodiments in accordance with the present invention may avoid this heat build-up as the edge contacting the formation changes. The lower temperatures at the edge of the cutting elements may decrease fracture potential, thereby extending the functional life of the cutting element. By decreasing the thermal and mechanical load experienced by the cutting surface of the cutting element, cutting element life may be increase, thereby allowing more efficient drilling.

Further, rotation of a rotatable portion of the cutting element may allow a cutting surface to cut formation using the entire outer edge of the cutting surface, rather than the same section of the outer edge, as provided by the prior art. The entire edge of the cutting element may contact the formation, generating more uniform cutting element edge wear, thereby preventing for formation of a local wear flat area. Because the edge wear is more uniform, the cutting element may not wear as quickly, thereby having a longer downhole life, and thus increasing the overall efficiency of the drilling operation.

Additionally, because the edge of the cutting element contacting the formation changes as the rotatable cutting portion of the cutting element rotates, the cutting edge may remain sharp. The sharp cutting edge may increase the rate of penetration while drilling formation, thereby increasing the efficiency of the drilling operation. Further, as the rotatable portion of the cutting element rotates, a hydraulic force may be applied to the cutting surface to cool and clean the surface of the cutting element.

Some embodiments may protect the cutting surface of a cutting element from side impact forces, thereby preventing premature cutting element fracture and subsequent failure. Still other embodiments may use a diamond table cutting surface as a bearing surface to reduce friction and provide extended wear life. As wear life of the cutting element embodiments increase, the potential of cutting element failure decreases. As such, a longer effective cutting element life may provide a higher rate of penetration, and ultimately result in a more efficient drilling operation.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A cutting tool comprising:

a tool body having a plurality of blades extending radially therefrom; and a plurality of rotatable cutting elements mounted on at least one of the plurality of blades, wherein each rotatable cutting element is rotatable around a cutting element axis extending through the rotatable cutting element; and wherein the plurality of rotatable cutting elements are mounted on the at least one blade in a forward spiral configuration, such that each of the plurality of rotatable cutting elements has an incrementally increasing radial distance from a tool body centerline and are placed in a clockwise distribution, when viewed from a cutting end of the cutting tool, and wherein each of the plurality of rotatable cutting elements has a positive side rake angle.

2. The cutting tool of claim 1, wherein the plurality of rotatable cutting elements are mounted on the at least one blade at side rake angles ranging from 0 to about 45 degrees.

3. The cutting tool of claim 1, wherein the plurality of rotatable cutting elements are mounted on the at least one blade at side rake angles ranging from 5 to about 35 degrees.

4. The cutting tool of claim 1, wherein the plurality of rotatable cutting elements are mounted on the at least one blade at side rake angles ranging from 15 to about 30 degrees.

5. The cutting tool of claim 1, wherein the plurality of rotatable cutting elements mounted in a nose region of the cutting tool has a side rake angle ranging from about 10 to about 30 degrees.

6. The cutting tool of claim 1, wherein the plurality of rotatable cutting elements mounted in a nose region of the cutting tool has a side rake angle ranging from about 20 to about 30 degrees.

7. The cutting tool of claim 1, wherein the plurality of rotatable cutting elements mounted in a shoulder region of the cutting tool has a side rake angle ranging from about 10 to about 30 degrees.

8. The cutting tool of claim 1, wherein the plurality of rotatable cutting elements mounted in a shoulder region of the cutting tool has a side rake angle ranging from about 20 to about 30 degrees.

9. The cutting tool of claim 1, wherein the plurality of rotatable cutting elements mounted in a gage region of the cutting tool have a side rake angle of less than 25 degrees.

10. The cutting tool of claim 1, wherein a plurality of cutting elements mounted in a cone region of the cutting tool have a side rake angle of less than 20 degrees.

11. The cutting tool of claim 10, wherein the plurality of cutting elements mounted in the cone region are rotatable.

12. The cutting tool of claim 11, wherein each of the cutting elements in a nose and shoulder region of the cutting tool are rotatable.

13. A cutting tool comprising:

a tool body having a plurality of blades extending radially therefrom; and a plurality of rotatable cutting elements mounted on at least one of the plurality of blades, wherein each rotatable cutting element is rotatable around a cutting element axis extending through the rotatable cutting element; and wherein the plurality of rotatable cutting elements are mounted on the at least one blade in a reverse spiral configuration, such that each of the plurality of rotatable cutting elements has an incrementally increasing radial distance from a tool body centerline and are placed in a counterclockwise distribution, when viewed from a cutting end of the cutting tool, and wherein each of the plurality of rotatable cutting elements has a positive side rake angle.

14. The cutting tool of claim 13, wherein the plurality of rotatable cutting elements are mounted on the at least one blade at side rake angles ranging from 0 to about 45 degrees.

15. The cutting tool of claim 13, wherein the plurality of rotatable cutting elements are mounted on the at least one blade at side rake angles ranging from 5 to about 35 degrees.

16. The cutting tool of claim 13, wherein the plurality of rotatable cutting elements are mounted on the at least one blade at side rake angles ranging from 15 to about 30 degrees.

17. The cutting tool of claim 13, wherein the plurality of rotatable cutting elements mounted in a nose region of the cutting tool has a side rake angle ranging from about 10 to about 30 degrees.

18. The cutting tool of claim 13, wherein the plurality of rotatable cutting elements mounted in a nose region of the cutting tool has a side rake angle ranging from about 20 to about 30 degrees.

19. The cutting tool of claim 13, wherein the plurality of rotatable cutting elements mounted in a shoulder region of the cutting tool has a side rake angle ranging from about 10 to about 30 degrees.

20. The cutting tool of claim 13, wherein the plurality of rotatable cutting elements mounted in a shoulder region of the cutting tool has a side rake angle ranging from about 20 to about 30 degrees.

21. The cutting tool of claim 13, wherein the plurality of rotatable cutting elements mounted in a gage region of the cutting tool have a side rake angle of less than 25 degrees.

22. The cutting tool of claim 13, wherein a plurality of cutting elements mounted in a cone region of the cutting tool have a side rake angle of less than 20 degrees.

23. The cutting tool of claim 13, wherein the plurality of cutting elements mounted in the cone region are rotatable.

24. The cutting tool of claim 13, wherein each of the cutting elements in a nose and shoulder region of the cutting tool are rotatable.

25. A cutting tool comprising:

a tool body having a plurality of blades extending radially therefrom; and a plurality of rotatable cutting elements mounted on at least one of the plurality of blades, wherein each rotatable cutting element is rotatable around a cutting element axis extending through the rotatable cutting element; and wherein the plurality of rotatable cutting elements are mounted on the at least one blade in a nose and/or shoulder region of the cutting tool at a side rake angle ranging from about 10 to about 25 degrees or −10 to about −25 degrees.

26. The cutting tool of claim 25, wherein the plurality of rotatable cutting elements are mounted in a reverse spiral configuration.

27. The cutting tool of claim 25, wherein the plurality of rotatable cutting elements are mounted in a forward spiral configuration.

28. The cutting tool of claim 25, wherein the plurality of rotatable cutting elements mounted in a nose region of the cutting tool has a side rake angle ranging from about 10 to about 25 degrees or from about −10 to about −25 degrees.

29. The cutting tool of claim 25, wherein the plurality of rotatable cutting elements mounted in a nose region of the cutting tool has a side rake angle ranging from about 20 to about 25 degrees or from about −20 to about −25 degrees.

30. The cutting tool of claim 25, wherein the plurality of rotatable cutting elements mounted in a shoulder region of the cutting tool has a side rake angle ranging from about 10 to about 25 degrees or from about −10 to about −25 degrees.

31. The cutting tool of claim 25, wherein the plurality of rotatable cutting elements mounted in a shoulder region of the cutting tool has a side rake angle ranging from about 20 to about 25 degrees or from about −20 to about −25 degrees.

32. The cutting tool of claim 25, wherein the plurality of rotatable cutting elements mounted in a gage region of the cutting tool have a side rake angle of less than ±25 degrees.

33. The cutting tool of claim 25, wherein a plurality of cutting elements mounted in a cone region of the cutting tool have a side rake angle of less than ±20 degrees.

34. The cutting tool of claim 33, wherein the plurality of cutting elements mounted in the cone region are rotatable.

35. The cutting tool of claim 25, wherein each of the cutting elements in a nose and shoulder region of the cutting tool are rotatable.

* * * * *